US012269662B2

(12) United States Patent
Ophardt et al.

(10) Patent No.: US 12,269,662 B2
(45) Date of Patent: Apr. 8, 2025

(54) FLEXIBLE MOUTH INSERT FOR POUCH

(71) Applicant: OP-Hygiene IP GmbH, Niederbipp (CH)

(72) Inventors: Heiner Ophardt, Arisdorf (CH); Padraig McDonagh, County Sligo (IE); John O'Malley, County Sligo (IE); Ali Mirbach, Issum (DE); Patrick Geurts, BK Roermond (NL)

(73) Assignee: OP-HYGIENE IP GMBH, Niederbipp (CH)

( * ) Notice: Subject to any disclaimer, the term of this patent is extended or adjusted under 35 U.S.C. 154(b) by 226 days.

(21) Appl. No.: 17/979,268

(22) Filed: Nov. 2, 2022

(65) Prior Publication Data

US 2023/0136872 A1 May 4, 2023

Related U.S. Application Data

(60) Provisional application No. 63/274,692, filed on Nov. 2, 2021.

(51) Int. Cl.
*B65D 75/58* (2006.01)
*B65D 75/30* (2006.01)

(52) U.S. Cl.
CPC ..... *B65D 75/5883* (2013.01); *B65D 75/30* (2013.01); *B65D 2575/583* (2013.01); *B65D 2575/586* (2013.01)

(58) Field of Classification Search
CPC ..... B65D 75/5883; B65D 75/30; B65D 2575/583; B65D 2575/586
See application file for complete search history.

(56) References Cited

U.S. PATENT DOCUMENTS 4,446,994 A * 5/1984 Smith ..... B65D 1/0238 222/541.9
4,917,267 A * 4/1990 Laverdure ..... B65D 1/0238 222/541.6
5,290,105 A * 3/1994 Tencati ..... B65D 47/36 383/203
5,823,383 A 10/1998 Hins
6,000,848 A 12/1999 Massioui
6,138,849 A 10/2000 Roemer et al.
6,860,406 B2 * 3/2005 Kobetsky ..... B29C 66/53263 222/107
7,232,042 B2 6/2007 Last
(Continued)

FOREIGN PATENT DOCUMENTS

DE 202006013587 1/2008
DE 202015103882 U1 10/2016
(Continued)

*Primary Examiner* — Bob Zadeh
(74) *Attorney, Agent, or Firm* — Thorpe North & Western, LLP

(57) ABSTRACT

A mouth insert for a flexible pouch. The mouth insert defines a passageway that extends along an axis from an axially outer end of the mouth insert to an axially inner end of the mouth insert. The mouth insert is flexible and includes a sealing portion and a lip portion. The sealing portion is for forming a sealed connection to the flexible pouch. The lip portion is configured to extend axially outwardly from the flexible pouch. The lip portion has an axial height that is less than ⅓ of the axial height of the mouth insert.

20 Claims, 14 Drawing Sheets

(56) References Cited

U.S. PATENT DOCUMENTS

| | | | | |
|---|---|---|---|---|
| 9,522,404 | B2 * | 12/2016 | Stehli, Jr. | B05B 11/0054 |
| 11,141,965 | B2 | 10/2021 | Ophardt et al. | |
| 2004/0007596 | A1 * | 1/2004 | Laverdure | B65D 33/2508 222/212 |
| 2005/0040181 | A1 | 2/2005 | Kurosawa et al. | |
| 2007/0056647 | A1 * | 3/2007 | Frayne | B65D 31/145 137/843 |
| 2009/0139993 | A1 | 6/2009 | Last | |
| 2011/0290798 | A1 | 12/2011 | Corbett et al. | |
| 2014/0110433 | A1 | 4/2014 | Schick | |
| 2017/0275064 | A1 | 9/2017 | Roosendaal et al. | |
| 2020/0023391 | A1 | 1/2020 | Cesare et al. | |

FOREIGN PATENT DOCUMENTS

| | | | | | |
|---|---|---|---|---|---|
| EP | 3036175 | B1 | | 5/2018 | |
| JP | H 111248 | | | 1/1997 | |
| JP | H1086951 | A | * | 4/1998 | B65D 75/5883 |
| JP | 11189249 | A | * | 7/1999 | B65D 75/5883 |
| WO | 9621599 | | | 7/1996 | |
| WO | WO-9630278 | A1 | * | 10/1996 | B65D 75/5883 |
| WO | WO-9906301 | A1 | * | 2/1999 | B29C 65/02 |
| WO | WO 2007/067029 | | | 6/2007 | |
| WO | 2013074953 | | | 5/2013 | |
| WO | WO 2015/114755 | A1 | | 8/2015 | |

* cited by examiner

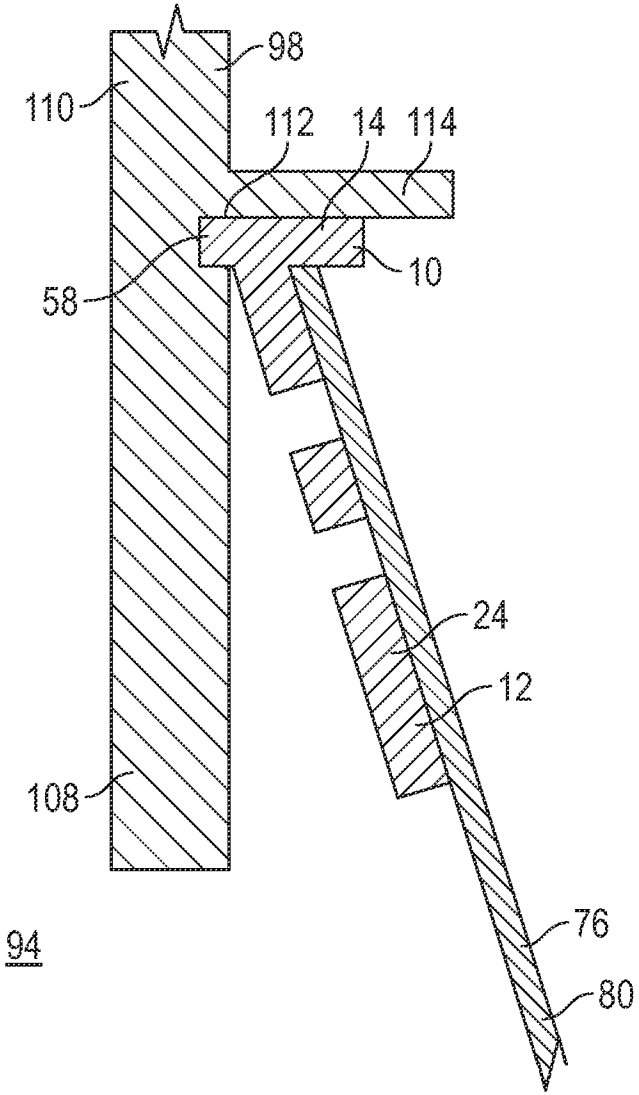
FIG. 11
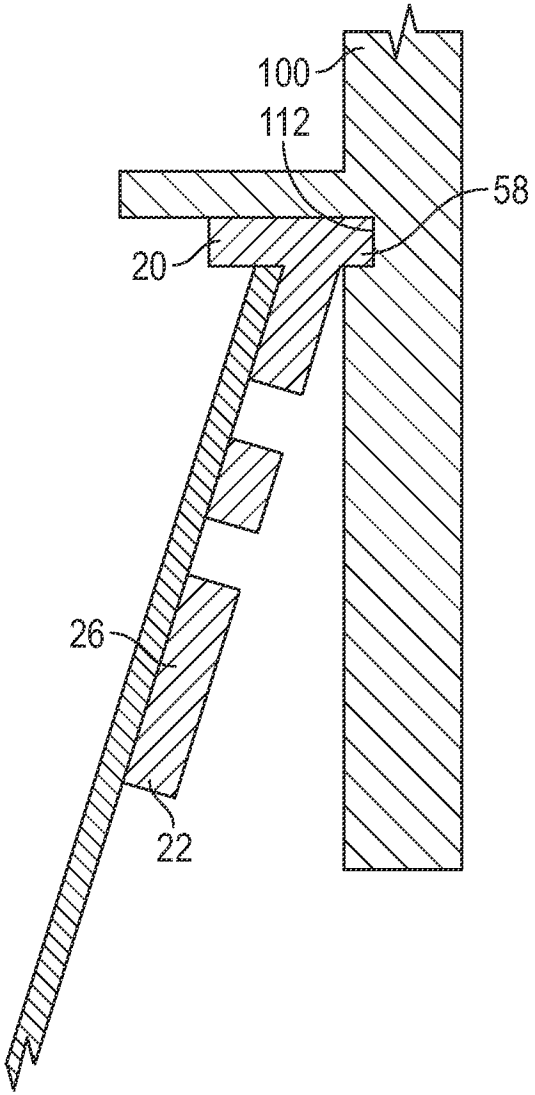

FLEXIBLE MOUTH INSERT FOR POUCH

RELATED APPLICATION

This application claims priority to the Nov. 2, 2021 filing date of U.S. Provisional Patent Application Ser. No. 63/274,692, which is incorporated herein by reference.

FIELD OF THE INVENTION

This invention relates to a flexible pouch, and more particularly to a flexible mouth insert for a flexible pouch.

BACKGROUND OF THE INVENTION

It is known to use a flexible pouch to contain a flowable substance, such as food, medicine, or hand sanitizer. The flexible pouch is typically provided with a rigid spout for filling and/or dispensing the flowable substance from the pouch. For example, United States Patent Application Publication No. US 2019/0358939 to Ophardt et al., published Nov. 28, 2019 and incorporated herein by reference, discloses a flexible pouch with an injection molded polyethylene spout. The spout has a sealing portion that is placed into an open end of the pouch and heat sealed in place. The spout also has an outlet portion that extends outwardly from the pouch, and provides an opening for receiving a fluid pump for dispensing fluid from the pouch.

Typically, the spout of a flexible pouch is made from a material and/or has a thickness that causes the spout to be rigid. This rigidity may be desired to provide a strong and relatively inflexible connection to another component, such as a fluid pump or a screw-top closure.

The inventors of the present invention have recognized a number of disadvantages of the prior art. For example, the rigid spouts often used in the prior art are relatively large and heavy, adding material costs and shipping costs. Furthermore, in order to provide the desired rigidity, the spouts are often made from a different material than the body of the pouch, with a different melting temperature. This can make it difficult to produce a strong heat sealed connection between the spout and the pouch body. Alternatively, if the spout is made from the same material as the pouch body, the spout may not have the desired degree of rigidity and/or other desired material properties.

SUMMARY OF THE INVENTION

To at least partially overcome some of the disadvantages of previously known methods and devices, in one aspect the present invention provides a flexible mouth insert for a flexible pouch. The mouth insert preferably includes a sealing portion for forming a sealed connection to the flexible pouch, and a lip portion configured to extend outwardly from the pouch. The lip portion preferably has a height that is less than ⅓ of the total height of the mouth insert.

The inventors of the present invention have appreciated that providing a flexible mouth insert for a flexible pouch advantageously allows the mouth of the pouch to be opened wide to allow for efficient filling of the pouch through the mouth insert, while also allowing the mouth to be flattened to enable compact and cost effective storage, shipping, and packaging. Making the mouth insert flexible and configured to extend only a short distance from the body of the pouch also allows the mouth insert to be manufactured using a relatively small amount of material, which preferably reduces material costs, shipping costs, and environmental costs.

Making the mouth insert flexible also allows the mouth insert to be made from the same material as the body of the flexible pouch. This preferably allows for more effective heat sealing between the mouth insert and the body of the pouch, and also preferably allows for easier recycling of the pouch.

Preferably, the mouth insert is configured to connect to an attachment, such as a closure, a spout, and/or a fluid pump. For example, the mouth insert may have a ridge or a groove that is configured to engage with the attachment in a snap fit. The attachment is optionally made from a different material than the mouth insert. This allows the attachment to, for example, be made from a rigid material with a different melting temperature than the flexible pouch, without impacting the strength of the heat seal between the mouth insert and the pouch.

Optionally, the pouch is manufactured and the mouth insert is heat sealed in place, and the pouch is then packaged, shipped, and/or sold in an empty state, without an attachment. The purchaser of the flexible pouch may then fill the pouch with a flowable substance, via the mouth insert, and then attach an attachment to the mouth insert such as a closure, a spout, and/or a fluid pump.

Advantageously, the same mouth insert design can be used to attach to a variety of different attachments. For example, one purchaser of the flexible pouch may fill the pouch with baby food and attach a twist-top closure to the mouth insert, and another purchaser may fill the pouch with hand sanitizer and attach a fluid pump to the mouth insert.

Preferably, the mouth insert is configured to connect to an attachment only at the outer end of the mouth insert, with the inner end of the mouth insert being unconnected to the attachment. This arrangement preferably helps to make the connection between the mouth insert and the attachment more resilient. In particular, when the flexible pouch is dropped or otherwise subjected to a compressive force, the inner end of the mouth insert is preferably able to flex outwardly, away from the attachment, to accommodate the fluid that is displaced by the compression. This preferably reduces the fluid pressure within the pouch, and thus reduces the force pulling the outer end of the mouth insert and away from the attachment.

Preferably, the sealing portion of the mouth insert has one or more slots that extend therethrough, so as to increase the flexibility of the mouth insert. This increased flexibility preferably helps to reduce the fluid pressure within the pouch during compression, in the manner as described above. Preferably, the slots have a wave-like shape.

The outer end of the mouth insert preferably forms a liquid tight seal with the attachment. Optionally, the mouth insert may be laser welded and/or ultrasonic welded to the attachment, in addition to or in place of the snap fit connection.

Accordingly, in a first aspect, the present invention resides in a mouth insert for a flexible pouch, the mouth insert defining a passageway that extends along an axis from an axially outer end of the mouth insert to an axially inner end of the mouth insert; the mouth insert comprising: a sealing portion for forming a sealed connection to the flexible pouch; and a lip portion configured to extend axially outwardly from the flexible pouch; wherein the mouth insert is flexible; wherein the lip portion defines the axially outer end of the mouth insert; wherein the mouth insert has a mouth insert axial height, the sealing portion has a sealing portion axial height, and the lip portion has a lip portion axial height; and wherein the lip portion axial height is less than ⅓ of the mouth insert axial height.

In a second aspect the present invention resides in a mouth insert, which optionally incorporates one or more features of the first aspect, wherein the sealing portion defines the axially inner end of the mouth insert; and wherein the mouth insert axial height is a sum of the sealing portion axial height and the lip portion axial height.

In a third aspect the present invention resides in a mouth insert, which optionally incorporates one or more features of one or more of the first and second aspects, wherein the sealing portion has a first sealing wall and a second sealing wall; wherein the first sealing wall and the second sealing wall each have an outer surface and an inner surface; wherein the outer surface of the first sealing wall is for forming the sealed connection to a first portion of the flexible pouch; wherein the outer surface of the second sealing wall is for forming the sealed connection to a second portion of the flexible pouch; and wherein the passageway is defined, in part, between the inner surface of the first sealing wall and the inner surface of the second sealing wall.

In a fourth aspect the present invention resides in a mouth insert, which optionally incorporates one or more features of one or more of the first to third aspects, wherein the lip portion has a first lip that extends axially outwardly from the first sealing wall of the sealing portion; wherein the lip portion has a second lip that extends axially outwardly from the second sealing wall of the sealing portion; wherein the first lip and the second lip each have an outside surface and an inside surface; and wherein the passageway is defined, in part, between the inside surface of the first lip and the inside surface of the second lip.

In a fifth aspect the present invention resides in a mouth insert, which optionally incorporates one or more features of one or more of the first to fourth aspects, wherein the inside surface of the first lip extends radially inwardly, past the inner surface of the first sealing wall, and the inside surface of the second lip extends radially inwardly, past the inner surface of the second sealing wall.

In a sixth aspect the present invention resides in a mouth insert, which optionally incorporates one or more features of one or more of the first to fifth aspects, wherein the inside surface of the first lip and the inside surface of the second lip are configured to connect to an attachment.

In a seventh aspect the present invention resides in a mouth insert, which optionally incorporates one or more features of one or more of the first to sixth aspects, wherein the attachment comprises at least one of: a spout, a closure, and a pump.

In an eighth aspect the present invention resides in a mouth insert, which optionally incorporates one or more features of one or more of the first to seventh aspects, wherein the inside surface of the first lip and the inside surface of the second lip are configured to form a snap fit connection with the attachment.

In a ninth aspect the present invention resides in a mouth insert, which optionally incorporates one or more features of one or more of the first to eighth aspects, wherein the inside surface of the first lip and the inside surface of the second lip are configured to form a liquid tight seal with the attachment.

In a tenth aspect the present invention resides in a mouth insert, which optionally incorporates one or more features of one or more of the first to ninth aspects, wherein the outside surface of the first lip extends radially outwardly, past the outer surface of the first sealing wall, and the outside surface of the second lip extends radially outwardly, past the outer surface of the second sealing wall.

In an eleventh aspect the present invention resides in a mouth insert, which optionally incorporates one or more features of one or more of the first to tenth aspects, wherein the first lip has a first axially inwardly facing shoulder that is configured to be positioned axially outwardly from an axially outer end of the first portion of the flexible pouch; and wherein the second lip has a second axially inwardly facing shoulder that is configured to be positioned axially outwardly from an axially outer end of the second portion of the flexible pouch.

In a twelfth aspect the present invention resides in a mouth insert, which optionally incorporates one or more features of one or more of the first to eleventh aspects, wherein the first sealing wall has at least one slot that extends radially through the first sealing wall from the inner surface to the outer surface; and wherein the second sealing wall has at least one slot that extends radially through the second sealing wall from the inner surface to the outer surface.

In a thirteenth aspect the present invention resides in a mouth insert, which optionally incorporates one or more features of one or more of the first to twelfth aspects, wherein the at least one slot in the first sealing wall and the at least one slot in the second sealing wall each extend in a transverse direction that is perpendicular to the axis.

In a fourteenth aspect the present invention resides in a mouth insert, which optionally incorporates one or more features of one or more of the first to thirteenth aspects, wherein the at least one slot in the first sealing wall comprises a first slot and a second slot, the first slot being axially spaced from the second slot; and wherein the at least one slot in the second sealing wall comprises a third slot and a fourth slot, the third slot being axially spaced from the fourth slot.

In a fifteenth aspect the present invention resides in a mouth insert, which optionally incorporates one or more features of one or more of the first to fourteenth aspects, wherein the at least one slot in the first sealing wall and the at least one slot in the second sealing wall each have a wave-like shape.

In a sixteenth aspect the present invention resides in a mouth insert, which optionally incorporates one or more features of one or more of the first to fifteenth aspects, wherein, when the mouth insert is in an unbiased condition, the mouth insert has an eye-like shape when viewed from the axis, with two convex walls that are connected at two corners; and wherein the passageway is defined between the two convex walls.

In a seventeenth aspect the present invention resides in a mouth insert, which optionally incorporates one or more features of one or more of the first to sixteenth aspects, wherein the two corners are rounded.

In an eighteenth aspect the present invention resides in a mouth insert, which optionally incorporates one or more features of one or more of the first to seventeenth aspects, wherein the mouth insert is injection molded.

In a nineteenth aspect the present invention resides in a mouth insert, which optionally incorporates one or more features of one or more of the first to eighteenth aspects, wherein the mouth insert is extrusion molded.

In a twentieth aspect the present invention resides in a mouth insert, which optionally incorporates one or more features of one or more of the first to nineteenth aspects, wherein the mouth insert is formed from LDPE.

In a twenty first aspect the present invention resides in a mouth insert, which optionally incorporates one or more features of one or more of the first to twentieth aspects, wherein the mouth insert is formed from PET.

In a twenty second aspect the present invention resides in a mouth insert, which optionally incorporates one or more features of one or more of the first to twenty first aspects, wherein the mouth insert is formed from rPET.

In a twenty third aspect the present invention resides in a mouth insert, which optionally incorporates one or more features of one or more of the first to twenty second aspects, wherein the mouth insert is formed from a single material.

In a twenty fourth aspect the present invention resides in a mouth insert, which optionally incorporates one or more features of one or more of the first to twenty third aspects, wherein the passageway is unobstructed.

In a twenty fifth aspect the present invention resides in a mouth insert, which optionally incorporates one or more features of one or more of the first to twenty fourth aspects, wherein the passageway is obstructed by a membrane.

In a twenty sixth aspect the present invention resides in a mouth insert, which optionally incorporates one or more features of one or more of the first to twenty fifth aspects, wherein the membrane is formed from at least one of: LDPE, PET, rPET, and rubber.

In a twenty seventh aspect the present invention resides in a mouth insert, which optionally incorporates one or more features of one or more of the first to twenty sixth aspects, wherein the membrane is elastic.

In a twenty eighth aspect the present invention resides in a mouth insert, which optionally incorporates one or more features of one or more of the first to twenty seventh aspects, wherein the lip portion axial height is less than ¼ of the mouth insert axial height.

In a twenty ninth aspect the present invention resides in a mouth insert, which optionally incorporates one or more features of one or more of the first to twenty eighth aspects, wherein the lip portion axial height is less than ⅕ of the mouth insert axial height.

In a thirtieth aspect the present invention resides in a mouth insert, which optionally incorporates one or more features of one or more of the first to twenty ninth aspects, wherein the lip portion axial height is less than ⅙ of the mouth insert axial height.

In a thirty first aspect the present invention resides in a mouth insert, which optionally incorporates one or more features of one or more of the first to thirtieth aspects, wherein the lip portion axial height is less than 5 mm.

In a thirty second aspect the present invention resides in a mouth insert, which optionally incorporates one or more features of one or more of the first to thirty first aspects, wherein the lip portion axial height is less than 4 mm.

In a thirty third aspect the present invention resides in a mouth insert, which optionally incorporates one or more features of one or more of the first to thirty second aspects, wherein the lip portion axial height is less than 3 mm.

In a thirty fourth aspect the present invention resides in a mouth insert, which optionally incorporates one or more features of one or more of the first to thirty second aspects, wherein the lip portion axial height is less than 2 mm.

In a thirty fifth aspect the present invention resides in a flexible pouch, which optionally incorporates one or more features of one or more of the first to thirty fourth aspects, the flexible pouch comprising: a film that defines an internal compartment of the flexible pouch; and a mouth insert that is sealed between a first portion of the film and a second portion of the film to define a mouth of the flexible pouch; the mouth insert defining a passageway that extends along an axis from an axially outer end of the mouth insert to an axially inner end of the mouth insert; wherein the passageway extends from the internal compartment of the flexible pouch, at the axially inner end of the mouth insert, to an external environment, at the axially outer end of the mouth insert; wherein the mouth insert is flexible; and wherein the mouth insert extends from 0 mm to 5 mm axially outwardly from the film.

In a thirty sixth aspect the present invention resides in a flexible pouch, which optionally incorporates one or more features of one or more of the first to thirty fifth aspects, wherein the mouth insert has a first sealing wall and a second sealing wall; wherein the first sealing wall and the second sealing wall each have an outer surface and an inner surface; wherein the outer surface of the first sealing wall is sealed to the first portion of the film; wherein the outer surface of the second sealing wall is sealed to the second portion of the film; and wherein the passageway is defined, at least in part, between the inner surface of the first sealing wall and the inner surface of the second sealing wall.

In a thirty seventh aspect the present invention resides in a flexible pouch, which optionally incorporates one or more features of one or more of the first to thirty sixth aspects, wherein the mouth insert has a snap fit connector that extends radially inwardly, past the inner surface of the first sealing wall and the inner surface of the second sealing wall.

In a thirty eighth aspect the present invention resides in a flexible pouch, which optionally incorporates one or more features of one or more of the first to thirty seventh aspects, wherein the snap fit connector is located at the axially outer end of the mouth insert.

In a thirty ninth aspect the present invention resides in a flexible pouch, which optionally incorporates one or more features of one or more of the first to thirty eighth aspects, wherein the snap fit connector is for forming a snap fit connection with an attachment.

In a fortieth aspect the present invention resides in a flexible pouch, which optionally incorporates one or more features of one or more of the first to thirty ninth aspects, wherein the attachment comprises at least one of: a spout, a closure, and a pump.

In a forty first aspect the present invention resides in a flexible pouch, which optionally incorporates one or more features of one or more of the first to fortieth aspects, wherein the snap fit connector is configured to form a liquid tight seal with the attachment.

In a forty second aspect the present invention resides in a flexible pouch, which optionally incorporates one or more features of one or more of the first to forty first aspects, further comprising an attachment that is attached to the mouth insert.

In a forty third aspect the present invention resides in a flexible pouch, which optionally incorporates one or more features of one or more of the first to forty second aspects, wherein the attachment comprises at least one of: a spout, a closure, and a pump.

In a forty fourth aspect the present invention resides in a flexible pouch, which optionally incorporates one or more features of one or more of the first to forty third aspects, wherein the attachment extends into the passageway.

In a forty fifth aspect the present invention resides in a flexible pouch, which optionally incorporates one or more features of one or more of the first to forty fourth aspects, wherein the attachment is connected to the mouth insert by at least one of: a snap fit connection, a laser weld, and an ultrasonic weld.

In a forty sixth aspect the present invention resides in a flexible pouch, which optionally incorporates one or more features of one or more of the first to forty fifth aspects, wherein the attachment is attached to the axially outer end of the mouth insert.

In a forty seventh aspect the present invention resides in a flexible pouch, which optionally incorporates one or more features of one or more of the first to forty sixth aspects, wherein the axially inner end of the mouth insert is unattached to the attachment.

In a forty eighth aspect the present invention resides in a flexible pouch, which optionally incorporates one or more features of one or more of the first to forty seventh aspects, wherein the mouth insert has a snap fit connector that extends radially inwardly, past the inner surface of the first sealing wall and the inner surface of the second sealing wall.

In a forty ninth aspect the present invention resides in a flexible pouch, which optionally incorporates one or more features of one or more of the first to forty eighth aspects, wherein the snap fit connector is located at the axially outer end of the mouth insert.

In a fiftieth aspect the present invention resides in a flexible pouch, which optionally incorporates one or more features of one or more of the first to forty ninth aspects, wherein the attachment has a groove; and wherein the groove receives the snap fit connector in a snap fit.

In a fifty first aspect the present invention resides in a flexible pouch, which optionally incorporates one or more features of one or more of the first to fiftieth aspects, wherein the mouth insert forms a liquid tight seal with the attachment.

In a fifty second aspect the present invention resides in a flexible pouch, which optionally incorporates one or more features of one or more of the first to fifty first aspects, wherein the attachment is formed from a different material than the mouth insert.

In a fifty third aspect the present invention resides in a flexible pouch, which optionally incorporates one or more features of one or more of the first to fifty second aspects, wherein the attachment is rigid.

In a fifty fourth aspect the present invention resides in a flexible pouch, which optionally incorporates one or more features of one or more of the first to fifty third aspects, wherein the attachment is formed from at least one of: HDPE and PP.

In a fifty fifth aspect the present invention resides in a flexible pouch, which optionally incorporates one or more features of one or more of the first to fifty fourth aspects, wherein the first sealing wall has at least one slot that extends radially through the first sealing wall from the inner surface to the outer surface; and wherein the second sealing wall has at least one slot that extends radially through the second sealing wall from the inner surface to the outer surface.

In a fifty sixth aspect the present invention resides in a flexible pouch, which optionally incorporates one or more features of one or more of the first to fifty fifth aspects, wherein the at least one slot in the first sealing wall and the at least one slot in the second sealing wall each extend in a transverse direction that is perpendicular to the axis.

In a fifty seventh aspect the present invention resides in a flexible pouch, which optionally incorporates one or more features of one or more of the first to fifty sixth aspects, wherein the at least one slot in the first sealing wall comprises a first slot and a second slot, the first slot being axially spaced from the second slot; and wherein the at least one slot in the second sealing wall comprises a third slot and a fourth slot, the third slot being axially spaced from the fourth slot.

In a fifty eighth aspect the present invention resides in a flexible pouch, which optionally incorporates one or more features of one or more of the first to fifty seventh aspects, wherein the at least one slot in the first sealing wall and the at least one slot in the second sealing wall each have a wave-like shape.

In a fifty ninth aspect the present invention resides in a flexible pouch, which optionally incorporates one or more features of one or more of the first to fifty eighth aspects, wherein, when the mouth insert is in an unbiased condition, the mouth insert has an eye-like shape when viewed from the axis, with two convex walls that are connected at two corners; and wherein the passageway is defined between the two convex walls.

In a sixtieth aspect the present invention resides in a flexible pouch, which optionally incorporates one or more features of one or more of the first to fifty ninth aspects, wherein the two corners are rounded.

In a sixty first aspect the present invention resides in a flexible pouch, which optionally incorporates one or more features of one or more of the first to sixtieth aspects, wherein the mouth insert is injection molded.

In a sixty second aspect the present invention resides in a flexible pouch, which optionally incorporates one or more features of one or more of the first to sixty first aspects, wherein the mouth insert is extrusion molded.

In a sixty third aspect the present invention resides in a flexible pouch, which optionally incorporates one or more features of one or more of the first to sixty second aspects, wherein the mouth insert is formed from LDPE.

In a sixty fourth aspect the present invention resides in a flexible pouch, which optionally incorporates one or more features of one or more of the first to sixty third aspects, wherein the mouth insert is formed from PET.

In a sixty fifth aspect the present invention resides in a flexible pouch, which optionally incorporates one or more features of one or more of the first to sixty fourth aspects, wherein the mouth insert is formed from rPET.

In a sixty sixth aspect the present invention resides in a flexible pouch, which optionally incorporates one or more features of one or more of the first to sixty fifth aspects, wherein the mouth insert is formed from a single material.

In a sixty seventh aspect the present invention resides in a flexible pouch, which optionally incorporates one or more features of one or more of the first to sixty sixth aspects, wherein the film is formed by blown film extrusion.

In a sixty eighth aspect the present invention resides in a flexible pouch, which optionally incorporates one or more features of one or more of the first to sixty seventh aspects, wherein the film is formed from a single material.

In a sixty ninth aspect the present invention resides in a flexible pouch, which optionally incorporates one or more features of one or more of the first to sixty eighth aspects, wherein the mouth insert and the film are formed from the same material.

In a seventieth aspect the present invention resides in a flexible pouch, which optionally incorporates one or more features of one or more of the first to sixty ninth aspects, wherein the film has multiple layers.

In a seventy first aspect the present invention resides in a flexible pouch, which optionally incorporates one or more features of one or more of the first to seventieth aspects, wherein the film has an inner layer that is sealed to the mouth insert; and wherein the mouth insert and the inner layer of the film are formed from the same material.

In a seventy second aspect the present invention resides in a flexible pouch, which optionally incorporates one or more features of one or more of the first to seventy first aspects, wherein the inner layer of the film comprises at least one of: LDPE, PET, and rPET.

In a seventy third aspect the present invention resides in a flexible pouch, which optionally incorporates one or more features of one or more of the first to seventy second aspects, wherein the film comprises at least one of: LDPE, PET, and rPET.

In a seventy fourth aspect the present invention resides in a flexible pouch, which optionally incorporates one or more features of one or more of the first to seventy third aspects, wherein the passageway is unobstructed.

In a seventy fifth aspect the present invention resides in a flexible pouch, which optionally incorporates one or more features of one or more of the first to seventy fourth aspects, wherein the passageway is obstructed by a membrane.

In a seventy sixth aspect the present invention resides in a flexible pouch, which optionally incorporates one or more features of one or more of the first to seventy fifth aspects, wherein the membrane is formed from at least one of: LDPE, PET, rPET, and rubber.

In a seventy seventh aspect the present invention resides in a flexible pouch, which optionally incorporates one or more features of one or more of the first to seventy sixth aspects, wherein the membrane is elastic.

In a seventy eighth aspect the present invention resides in a flexible pouch, which optionally incorporates one or more features of one or more of the first to seventy seventh aspects, wherein the mouth insert extends less than 4 mm axially outwardly from the film.

In a seventy ninth aspect the present invention resides in a flexible pouch, which optionally incorporates one or more features of one or more of the first to seventy eighth aspects, wherein the mouth insert extends less than 3 mm axially outwardly from the film.

In an eightieth aspect the present invention resides in a flexible pouch, which optionally incorporates one or more features of one or more of the first to seventy ninth aspects, wherein the mouth insert extends less than 2 mm axially outwardly from the film.

In an eighty first aspect the present invention resides in a flexible pouch, which optionally incorporates one or more features of one or more of the first to eightieth aspects, wherein the mouth insert is the mouth insert according to any one of the first to thirty fourth aspects.

In an eighty second aspect the present invention resides in a method of producing a flexible pouch, which optionally incorporates one or more features of one or more of the first to eighty first aspects, the method comprising: producing a flexible film that defines an internal compartment of the flexible pouch; producing a flexible mouth insert, the flexible mouth insert defining a passageway that extends along an axis from an axially outer end of the mouth insert to an axially inner end of the mouth insert; positioning the flexible mouth insert between a first portion of the flexible film and a second portion of the flexible film, so that the flexible mouth insert extends from 0 mm to 5 mm axially outwardly from the flexible film; and sealing the flexible mouth insert to the first portion of the flexible film and the second portion of the flexible film, so that the flexible mouth insert defines a mouth of the flexible pouch, with the passageway extending from the internal compartment, at the axially inner end of the flexible mouth insert, to an external environment, at the axially outer end of the flexible mouth insert.

In an eighty third aspect the present invention resides in a method of producing a flexible pouch, which optionally incorporates one or more features of one or more of the first to eighty second aspects, wherein sealing the flexible mouth insert to the first portion of the flexible film and the second portion of the flexible film comprises: inserting a core pin into the passageway; applying heat to the flexible film to heat seal the flexible mouth insert to the first portion of the flexible film and the second portion of the flexible film; and removing the core pin from the passageway.

In an eighty fourth aspect the present invention resides in a method of producing a flexible pouch, which optionally incorporates one or more features of one or more of the first to eighty third aspects, wherein producing the flexible film comprises producing the flexible film by blown film extrusion.

In an eighty fifth aspect the present invention resides in a method of producing a flexible pouch, which optionally incorporates one or more features of one or more of the first to eighty fourth aspects, wherein producing the flexible mouth insert comprises producing the flexible mouth insert by injection molding.

In an eighty sixth aspect the present invention resides in a method of producing a flexible pouch, which optionally incorporates one or more features of one or more of the first to eighty fifth aspects, wherein producing the flexible mouth insert comprises producing the flexible mouth insert by extrusion molding.

In an eighty seventh aspect the present invention resides in a method of producing a flexible pouch, which optionally incorporates one or more features of one or more of the first to eighty sixth aspects, further comprising: filling the internal compartment of the flexible pouch with a fluid.

In an eighty eighth aspect the present invention resides in a method of producing a flexible pouch, which optionally incorporates one or more features of one or more of the first to eighty seventh aspects, wherein the fluid is introduced into the internal compartment through the passageway defined by the flexible mouth insert.

In an eighty ninth aspect the present invention resides in a method of producing a flexible pouch, which optionally incorporates one or more features of one or more of the first to eighty eighth aspects, wherein the flexible mouth insert has a membrane that obstructs the passageway; and wherein filling the internal compartment comprises puncturing the membrane.

In a ninetieth aspect the present invention resides in a method of producing a flexible pouch, which optionally incorporates one or more features of one or more of the first to eighty ninth aspects, wherein the fluid is a hand cleaning fluid.

In a ninety first aspect the present invention resides in a method of producing a flexible pouch, which optionally incorporates one or more features of one or more of the first to ninetieth aspects, further comprising: attaching an attachment to the flexible mouth insert.

In a ninety second aspect the present invention resides in a method of producing a flexible pouch, which optionally incorporates one or more features of one or more of the first to ninety first aspects, wherein the attachment comprises at least one of: a spout, a closure, and a pump.

In a ninety third aspect the present invention resides in a method of producing a flexible pouch, which optionally incorporates one or more features of one or more of the first to ninety second aspects, wherein the attachment comprises a pump.

In a ninety fourth aspect the present invention resides in a method of producing a flexible pouch, which optionally incorporates one or more features of one or more of the first to ninety third aspects, wherein attaching the attachment to the flexible mouth insert comprises inserting the attachment into the passageway of the flexible mouth insert.

In a ninety fifth aspect the present invention resides in a method of producing a flexible pouch, which optionally incorporates one or more features of one or more of the first to ninety fourth aspects, wherein attaching the attachment to the flexible mouth insert comprises attaching the attachment to the flexible mouth insert with a snap fit.

In a ninety sixth aspect the present invention resides in a method of producing a flexible pouch, which optionally incorporates one or more features of one or more of the first to ninety fifth aspects, wherein attaching the attachment to the flexible mouth insert comprises laser welding the attachment to the flexible mouth insert.

In a ninety seventh aspect the present invention resides in a method of producing a flexible pouch, which optionally incorporates one or more features of one or more of the first to ninety sixth aspects, wherein attaching the attachment to the flexible mouth insert comprises ultrasonic welding the attachment to the flexible mouth insert.

In a ninety eighth aspect the present invention resides in a method of producing a flexible pouch, which optionally incorporates one or more features of one or more of the first to ninety seventh aspects, wherein attaching the attachment to the flexible mouth insert comprises attaching the attachment to the axially outer end of the flexible mouth insert, without attaching the attachment to the axially inner end of the flexible mouth insert.

In a ninety ninth aspect the present invention resides in a method of producing a flexible pouch, which optionally incorporates one or more features of one or more of the first to ninety eighth aspects, wherein the attachment is attached to the flexible mouth insert before the flexible mouth insert is sealed to the first portion of the flexible film and the second portion of the flexible film.

In a one hundredth aspect the present invention resides in a method of producing a flexible pouch, which optionally incorporates one or more features of one or more of the first to ninety ninth aspects, wherein the flexible pouch is the flexible pouch according to any one of the thirty fifth to eighty first aspects.

In a one hundred and first aspect the present invention resides in a mouth insert, which optionally incorporates one or more features of one or more of the first to one hundredth aspects, wherein the sealing portion is for forming a heat sealed connection to the flexible pouch.

In a one hundred and second aspect the present invention resides in a mouth insert, which optionally incorporates one or more features of one or more of the first to one hundred and first aspects, wherein the sealing portion is for forming a laser welded connection to the flexible pouch.

In a one hundred and third aspect the present invention resides in a flexible pouch, which optionally incorporates one or more features of one or more of the first to one hundred and second aspects, wherein the mouth insert is heat sealed to the first portion of the film and the second portion of the film.

In a one hundred and fourth aspect the present invention resides in a flexible pouch, which optionally incorporates one or more features of one or more of the first to one hundred and third aspects, wherein the mouth insert is laser welded to the first portion of the film and the second portion of the film.

In a one hundred and fifth aspect the present invention resides in a method, which optionally incorporates one or more features of one or more of the first to one hundred and fourth aspects, wherein sealing the flexible mouth insert to the first portion of the flexible film and the second portion of the flexible film comprises: heat sealing the flexible mouth insert to the first portion of the flexible film and the second portion of the flexible film.

In a one hundred and sixth aspect the present invention resides in a method, which optionally incorporates one or more features of one or more of the first to one hundred and fifth aspects, wherein sealing the flexible mouth insert to the first portion of the flexible film and the second portion of the flexible film comprises: laser welding the flexible mouth insert to the first portion of the flexible film and the second portion of the flexible film.

In a one hundred and seventh aspect the present invention resides in a method, which optionally incorporates one or more features of one or more of the first to one hundred and sixth aspects, wherein the flexible mouth insert is laser welded to the first portion of the flexible film and the second portion of the flexible film after the flexible mouth insert is heat sealed to the first portion of the flexible film and the second portion of the flexible film.

In a one hundred and eighth aspect the present invention resides in a flexible pouch, which optionally incorporates one or more features of one or more of the first to one hundred and seventh aspects, comprising; a film that defines an internal compartment of the flexible pouch; and a mouth insert that is sealed between a first portion of the film and a second portion of the film to define a mouth of the flexible pouch; the mouth insert defining a passageway that extends along an axis from an axially outer end of the mouth insert to an axially inner end of the mouth insert; wherein the passageway extends from the internal compartment of the flexible pouch, at the axially inner end of the mouth insert, to an external environment, at the axially outer end of the mouth insert; and wherein the mouth insert is flexible.

In a one hundred and ninth aspect the present invention resides in a method, which optionally incorporates one or more features of one or more of the first to one hundred and eighth aspects, comprising: producing a flexible film; producing a flexible mouth insert, the flexible mouth insert defining a passageway that extends along an axis from an axially outer end of the mouth insert to an axially inner end of the mouth insert; positioning the flexible mouth insert between a first portion of the flexible film and a second portion of the flexible film; and sealing the flexible mouth insert to the first portion of the flexible film and the second portion of the flexible film, so that the flexible mouth insert and the flexible film together form a flexible pouch, with the flexible film defining an internal compartment of the flexible pouch and the flexible mouth insert defining a mouth of the flexible pouch, with the passageway extending from the internal compartment, at the axially inner end of the flexible mouth insert, to an external environment, at the axially outer end of the flexible mouth insert.

In a one hundred and tenth aspect the present invention resides in a mouth insert for a flexible pouch, which optionally incorporates one or more features of one or more of the first to one hundred and ninth aspects, the mouth insert defining a passageway that extends along an axis from an axially outer end of the mouth insert to an axially inner end of the mouth insert; the mouth insert comprising: a sealing portion for forming a sealed connection to the flexible pouch; and a lip portion configured to extend axially outwardly from the flexible pouch; wherein the mouth insert is flexible; and wherein the lip portion defines the axially outer end of the mouth insert.

In a one hundred and eleventh aspect the present invention resides in a flexible pouch, which optionally incorporates one or more features of one or more of the first to one hundred and tenth aspects, comprising: a film that defines an internal compartment of the flexible pouch; and a mouth insert that is sealed between a first portion of the film and a second portion of the film to define a mouth of the flexible pouch; the mouth insert defining a passageway that extends along an axis from an axially outer end of the mouth insert to an axially inner end of the mouth insert; wherein the passageway extends from the internal compartment of the flexible pouch, at the axially inner end of the mouth insert, to an external environment, at the axially outer end of the mouth insert; wherein the mouth insert is flexible; and wherein the mouth insert extends from 0 mm to 5 mm axially outwardly from the film.

In a one hundred and twelfth aspect the present invention resides in a flexible pouch, which optionally incorporates one or more features of one or more of the first to one hundred and eleventh aspects, wherein the mouth insert comprises: a sealing portion that is sealed between the first portion of the film and the second portion of the film; and a lip portion configured to extend axially outwardly from the film; wherein the lip portion defines the axially outer end of the mouth insert; wherein the mouth insert has a mouth insert axial height, the sealing portion has a sealing portion axial height, and the lip portion has a lip portion axial height; wherein the lip portion axial height is less than ⅓ of the mouth insert axial height; wherein the sealing portion defines the axially inner end of the mouth insert; and wherein the mouth insert axial height is a sum of the sealing portion axial height and the lip portion axial height.

In a one hundred and thirteenth aspect the present invention resides in a flexible pouch, which optionally incorporates one or more features of one or more of the first to one hundred and twelfth aspects, wherein the sealing portion has a first sealing wall and a second sealing wall; wherein the first sealing wall and the second sealing wall each have an outer surface and an inner surface; wherein the outer surface of the first sealing wall is sealed to the first portion of the film; wherein the outer surface of the second sealing wall is sealed to the second portion of the film; and wherein the passageway is defined, in part, between the inner surface of the first sealing wall and the inner surface of the second sealing wall.

In a one hundred and fourteenth aspect the present invention resides in a flexible pouch, which optionally incorporates one or more features of one or more of the first to one hundred and thirteenth aspects, wherein the lip portion has a first lip that extends axially outwardly from the first sealing wall of the sealing portion; wherein the lip portion has a second lip that extends axially outwardly from the second sealing wall of the sealing portion; wherein the first lip and the second lip each have an outside surface and an inside surface; wherein the passageway is defined, in part, between the inside surface of the first lip and the inside surface of the second lip; and wherein the inside surface of the first lip extends radially inwardly, past the inner surface of the first sealing wall, and the inside surface of the second lip extends radially inwardly, past the inner surface of the second sealing wall.

In a one hundred and fifteenth aspect the present invention resides in a flexible pouch, which optionally incorporates one or more features of one or more of the first to one hundred and fourteenth aspects, further comprising an attachment that is attached to the mouth insert; wherein the attachment extends into the passageway; wherein the attachment is attached to the lip portion of the mouth insert; and wherein the attachment is unattached to the sealing portion of the mouth insert.

In a one hundred and sixteenth aspect the present invention resides in a flexible pouch, which optionally incorporates one or more features of one or more of the first to one hundred and fifteenth aspects, wherein the attachment comprises at least one of: a spout, a closure, and a pump; and wherein the attachment is connected to the mouth insert by at least one of: a snap fit connection, a laser weld, and an ultrasonic weld.

In a one hundred and seventeenth aspect the present invention resides in a flexible pouch, which optionally incorporates one or more features of one or more of the first to one hundred and sixteenth aspects, wherein the attachment has at least one groove that receives the inside surface of the first lip and the inside surface of the second lip in a snap fit.

In a one hundred and eighteenth aspect the present invention resides in a flexible pouch, which optionally incorporates one or more features of one or more of the first to one hundred and seventeenth aspects, wherein the mouth insert forms a liquid tight seal with the attachment; wherein the attachment is formed from a different material than the mouth insert; wherein the attachment is rigid; and wherein the attachment is formed from at least one of: HDPE and PP.

In a one hundred and nineteenth aspect the present invention resides in a flexible pouch, which optionally incorporates one or more features of one or more of the first to one hundred and eighteenth aspects, wherein the outside surface of the first lip extends radially outwardly, past the outer surface of the first sealing wall, and the outside surface of the second lip extends radially outwardly, past the outer surface of the second sealing wall; wherein the first lip has a first axially inwardly facing shoulder that is positioned axially outwardly from an axially outer end of the first portion of the film; and wherein the second lip has a second axially inwardly facing shoulder that is positioned axially outwardly from an axially outer end of the second portion of the film.

In a one hundred and twentieth aspect the present invention resides in a flexible pouch, which optionally incorporates one or more features of one or more of the first to one hundred and nineteenth aspects, wherein the first sealing wall has at least one slot that extends radially through the first sealing wall from the inner surface to the outer surface; wherein the second sealing wall has at least one slot that extends radially through the second sealing wall from the inner surface to the outer surface; and wherein the at least one slot in the first sealing wall and the at least one slot in the second sealing wall each extend in a transverse direction that is perpendicular to the axis.

In a one hundred and twenty first aspect the present invention resides in a flexible pouch, which optionally incorporates one or more features of one or more of the first to one hundred and twentieth aspects, wherein the at least one slot in the first sealing wall and the at least one slot in the second sealing wall each have a wave-like shape.

In a one hundred and twenty second aspect the present invention resides in a flexible pouch, which optionally incorporates one or more features of one or more of the first to one hundred and twenty first aspects, wherein, when the mouth insert is in an unbiased condition, the mouth insert has an eye-like shape when viewed from the axis, with two convex walls that are connected at two corners; and wherein the passageway is defined between the two convex walls.

In a one hundred and twenty third aspect the present invention resides in a flexible pouch, which optionally incorporates one or more features of one or more of the first to one hundred and twenty second aspects, wherein the mouth insert is at least one of: injection molded; extrusion molded; formed from LDPE; formed from PET; and formed from rPET.

In a one hundred and twenty fourth aspect the present invention resides in a flexible pouch, which optionally incorporates one or more features of one or more of the first to one hundred and twenty third aspects, wherein the mouth insert and the film are formed from the same material; or the film has an inner layer that is sealed to the mouth insert, and the mouth insert and the inner layer of the film are formed from the same material.

In a one hundred and twenty fifth aspect the present invention resides in a flexible pouch, which optionally incorporates one or more features of one or more of the first to one hundred and twenty fourth aspects, wherein the passageway is obstructed by a membrane; wherein the membrane is elastic; and wherein the lip portion axial height is less than ⅙ of the mouth insert axial height.

In a one hundred and twenty sixth aspect the present invention resides in a flexible pouch, which optionally incorporates one or more features of one or more of the first to one hundred and twenty fifth aspects, wherein the attachment has at least one groove that receives the inside surface of the first lip and the inside surface of the second lip in a snap fit; wherein the mouth insert forms a liquid tight seal with the attachment; wherein the attachment is formed from a different material than the mouth insert; wherein the attachment is rigid; and wherein the attachment is formed from at least one of: HDPE and PP.

In a one hundred and twenty seventh aspect the present invention resides in a flexible pouch, which optionally incorporates one or more features of one or more of the first to one hundred and twenty sixth aspects, wherein the outside surface of the first lip extends radially outwardly, past the outer surface of the first sealing wall, and the outside surface of the second lip extends radially outwardly, past the outer surface of the second sealing wall; wherein the first lip has a first axially inwardly facing shoulder that is positioned axially outwardly from an axially outer end of the first portion of the film; wherein the second lip has a second axially inwardly facing shoulder that is positioned axially outwardly from an axially outer end of the second portion of the film; wherein the first sealing wall has at least one slot that extends radially through the first sealing wall from the inner surface to the outer surface; wherein the second sealing wall has at least one slot that extends radially through the second sealing wall from the inner surface to the outer surface; wherein the at least one slot in the first sealing wall and the at least one slot in the second sealing wall each extend in a transverse direction that is perpendicular to the axis; and wherein the at least one slot in the first sealing wall and the at least one slot in the second sealing wall each have a wave-like shape.

In a one hundred and twenty eighth aspect the present invention resides in a flexible pouch, which optionally incorporates one or more features of one or more of the first to one hundred and twenty seventh aspects, wherein, when the mouth insert is in an unbiased condition, the mouth insert has an eye-like shape when viewed from the axis, with two convex walls that are connected at two corners; wherein the passageway is defined between the two convex walls; and wherein the mouth insert is at least one of: injection molded; extrusion molded; formed from LDPE; formed from PET; and formed from rPET.

In a one hundred and twenty ninth aspect the present invention resides in a flexible pouch, which optionally incorporates one or more features of one or more of the first to one hundred and twenty eighth aspects, wherein the mouth insert and the film are formed from the same material; or the film has an inner layer that is sealed to the mouth insert, and the mouth insert and the inner layer of the film are formed from the same material.

In a one hundred and thirtieth aspect the present invention resides in a flexible pouch, which optionally incorporates one or more features of one or more of the first to one hundred and twenty ninth aspects, wherein the passageway is obstructed by a membrane; wherein the membrane is elastic; and wherein the lip portion axial height is less than ⅙ of the mouth insert axial height.

BRIEF DESCRIPTION OF THE DRAWINGS

Further aspects and advantages of the invention will appear from the following description taken together with the accompanying drawings, in which:

FIG. 11 is a schematic cross-sectional view of the flexible pouch with the spout connected to the mouth insert as shown in FIG. 10, showing the mouth insert in a biased condition adopted when the flexible pouch is subjected to a compressive force;

DETAILED DESCRIPTION OF THE DRAWINGS

Figure 1:
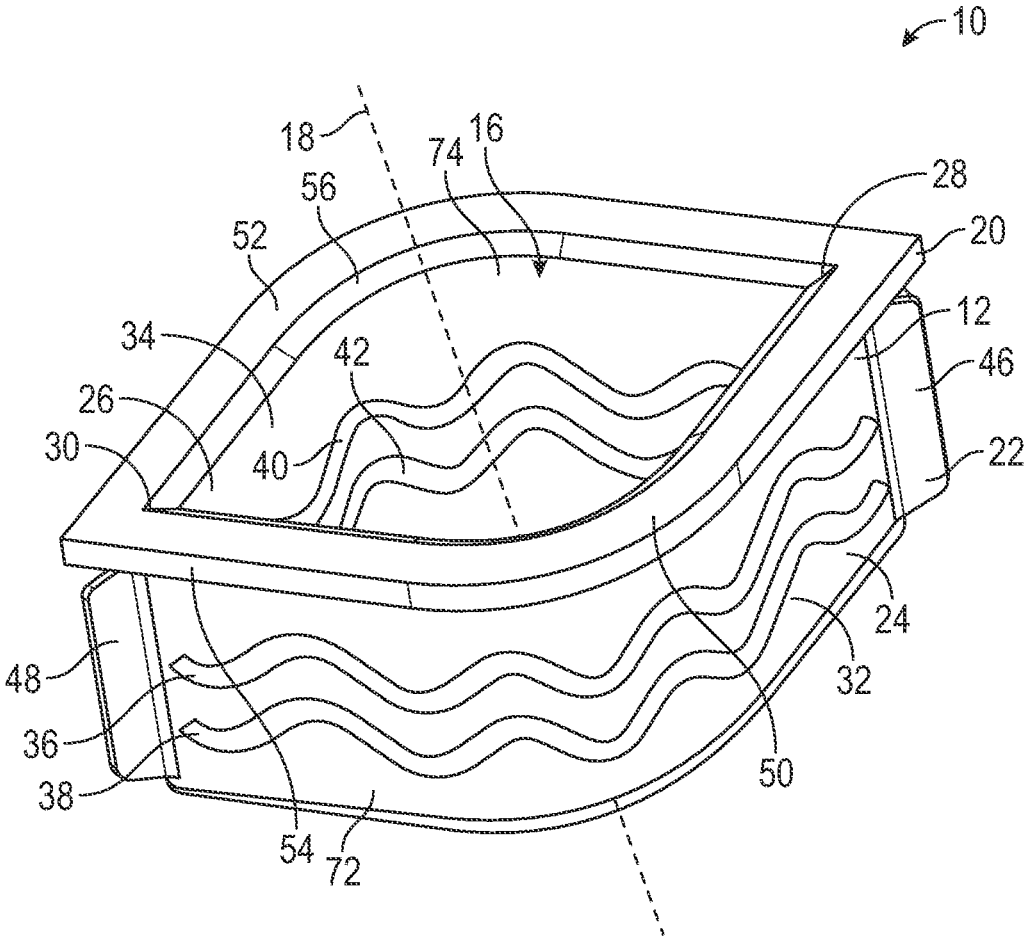
FIG. 1 is a top perspective view of a mouth insert in accordance with a first embodiment of the present invention.
Figure 2:
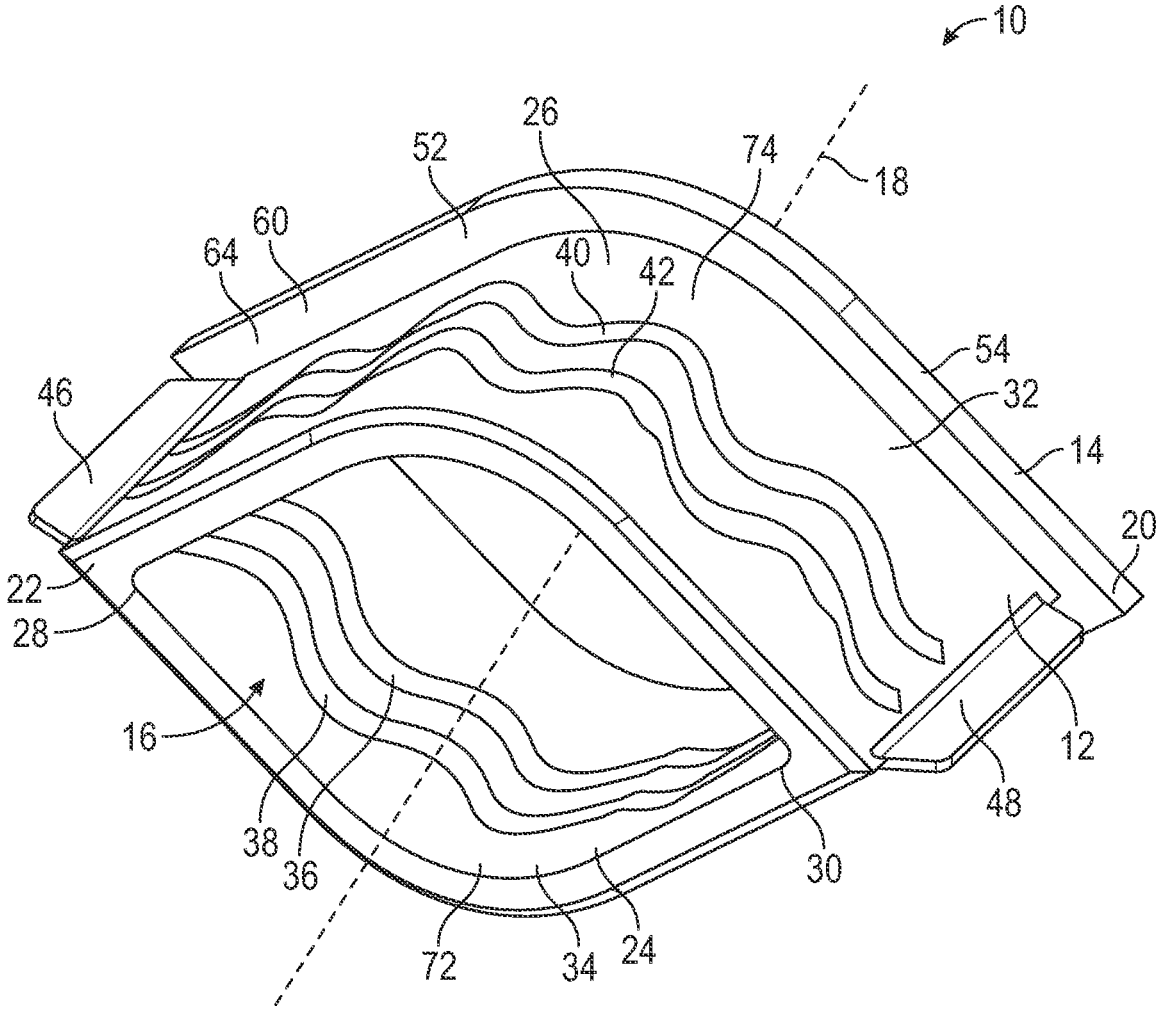
FIG. 2 is a bottom perspective view of the mouth insert shown in FIG. 1.
Figure 3:
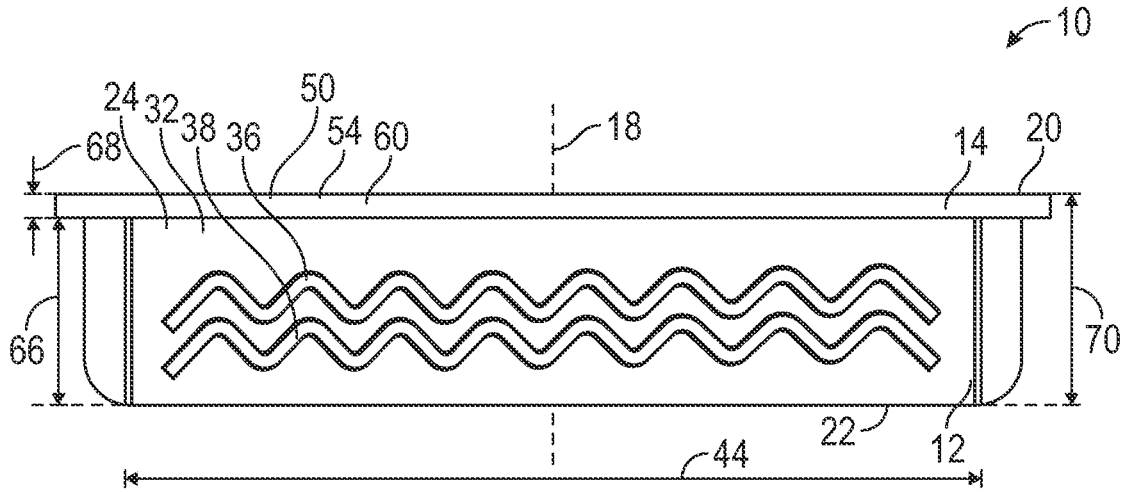
FIG. 3 is a side view of the mouth insert shown in FIG. 1.

FIGS. 1 to 3 show a flexible mouth insert 10 in accordance with a first embodiment of the present invention. The mouth insert 10 has a sealing portion 12 and a lip portion 14, and defines a passageway 16 that extends along an axis 18 from an axially outer end 20 of the mouth insert 10 to an axially inner end 22 of the mouth insert 10.

The sealing portion 12 defines the axially inner end 22 of the mouth insert 10, and has a first sealing wall 24 and a second sealing wall 26. The first sealing wall 24 is connected to the second sealing wall 26 at a first corner 28 and at a second corner 30. The first sealing wall 24 and the second sealing wall 26 each have an outer surface 32, which faces radially away from the axis 18, and an inner surface 34, which faces radially towards the axis 18. The passageway 16 is defined, in part, between the inner surface 34 of the first sealing wall 24 and the inner surface 34 of the second sealing wall 26. A first sealing tab 46 extends radially outwardly from the first corner 28, and a second sealing tab 48 extends radially outwardly from the second corner 30. The radially inner surfaces of the first corner 28 and the second corner 30 are preferably rounded.

As can be seen in FIG. 1, the first sealing wall 24 has a first slot 36 and a second slot 38, and the second sealing wall 26 has a third slot 40 and a fourth slot 42. Each of the first slot 36 and the second slot 38 extend radially through the first sealing wall 24, from the inner surface 34 to the outer surface 32, and each of the third slot 40 and the fourth slot 42 extend radially through the second sealing wall 26, from the inner surface 34 to the outer surface 32.

Each of the first slot 36, the second slot 38, the third slot 40, and the fourth slot 42 extend in a transverse direction 44 that is perpendicular to the axis 18. The first slot 36 is spaced axially outwardly from the second slot 38, and the third slot 40 is spaced axially outwardly from the fourth slot 42. In the embodiment shown, each of the first slot 36, the second slot 38, the third slot 40, and the fourth slot 42 has a wave-like shape.

The lip portion 14 defines the axially outer end 20 of the mouth insert 10, and has a first lip 50 that extends axially outwardly from the first sealing wall 24, and a second lip 52 that extends axially outwardly from the second sealing wall 26. The first lip 50 and the second lip 52 each have an outside surface 54 that faces radially away from the axis 18, and an inside surface 56 that faces radially towards the axis 18. The passageway 16 is defined, in part, between the inside surface 56 of the first lip 50 and the inside surface 56 of the second lip 52.

Figure 8:
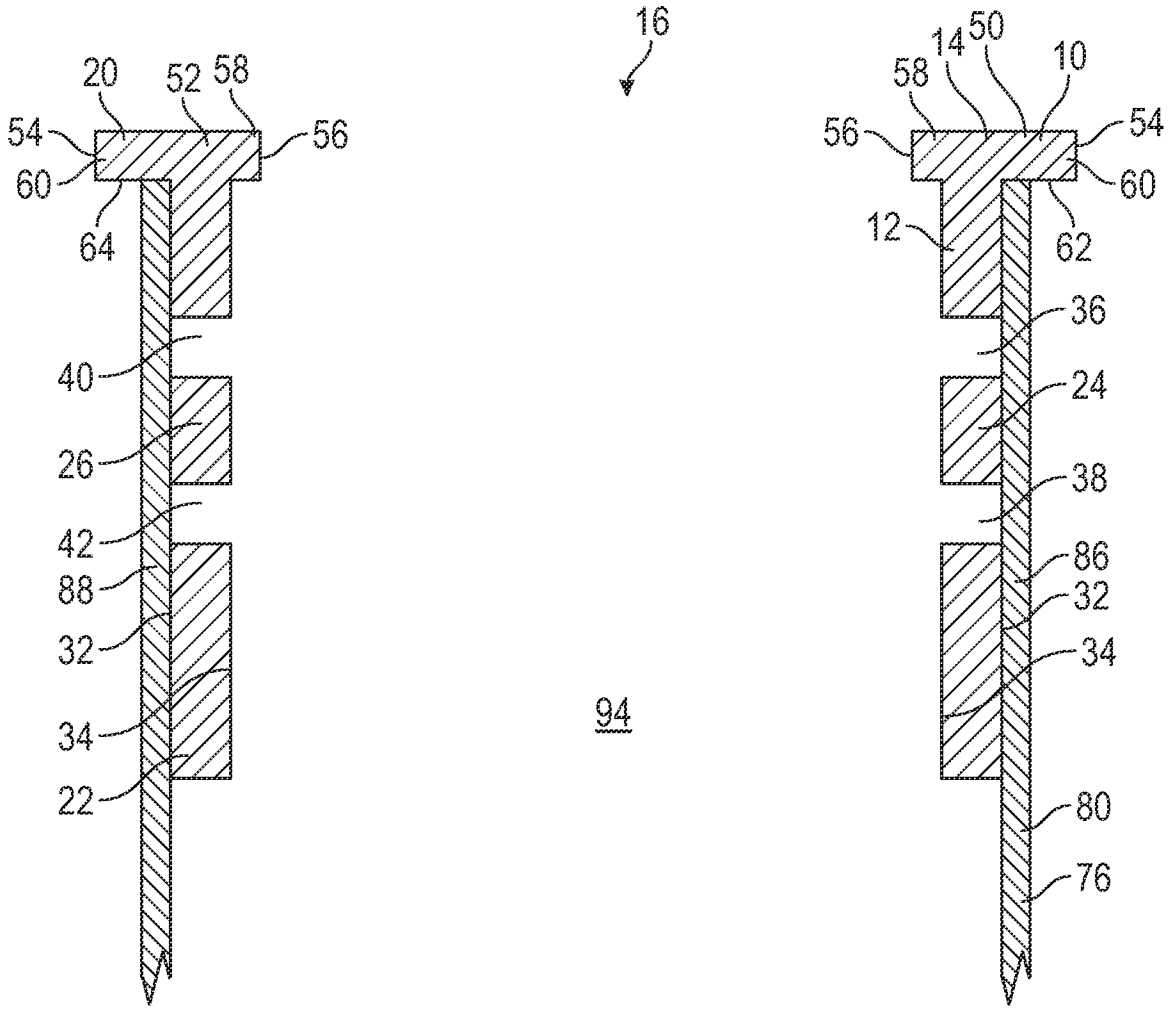
FIG. 8 is a schematic cross-sectional view of the flexible pouch with the mouth insert forming the mouth of the flexible pouch as shown in FIG. 5.

As is best shown in FIG. 8, the first lip 50 and the second lip 52 each have a radially inwardly extended ridge 58. The ridge 58 of the first lip 50 extends further radially inwardly than the inner surface 34 of the first sealing wall 24, and the ridge 58 of the second lip 52 extends further radially inwardly than the inner surface 34 of the second sealing wall 26. This causes the passageway 16 to have a smaller circumference at the axial height of the lip portion 14 than at the axial height of the sealing portion 12.

The first lip 50 and the second lip 52 also each have a radially outwardly extended collar 60. The collar 60 of the first lip 50 extends further radially outwardly than the outer surface 32 of the first sealing wall 24, and the collar 60 of the second lip 52 extends further radially outwardly than the outer surface 32 of the second sealing wall 26. As can be seen in FIG. 8, the collar 60 of the first lip 50 has a first axially inwardly facing shoulder 62, and the collar 60 of the second lip 52 has a second axially inwardly facing shoulder 64.

Referring to FIG. 3, the sealing portion 12 has a sealing portion axial height 66, the lip portion 14 has a lip portion axial height 68, and the mouth insert 10 has a mouth insert axial height 70. The mouth insert axial height 70 is the sum of the sealing portion axial height 66 and the lip portion axial height 68. The lip portion axial height 68 is preferably less than ⅓ of the mouth insert axial height 70; more preferably less than ¼ of the mouth insert axial height 70; and even more preferably less than ⅕ or less than ⅙ of the mouth insert axial height 70.

As can be seen in FIGS. 1 and 2, when the mouth insert 10 is in an unbiased condition, the mouth insert 10 has an eye-like shape when viewed from the axis 18, with the first sealing wall 24 and the first lip 50 defining a first convex wall 72, and the second sealing wall 26 and the second lip 52 defining a second convex wall 74. The passageway 16 is defined between the two convex walls 72, 74. Because the mouth insert 10 is flexible, the two convex walls 72, 74 can be drawn away from each other so that the passageway 16 has a more cylindrical shape, or can be pushed towards each other so that the passageway 16 has a more flattened shape.

The mouth insert 10 is optionally formed by injection molding or extrusion molding. Preferably, the mouth insert 10 is formed from a single material that is flexible, and has good heat sealing properties. The material is also preferably easily recyclable. The mouth insert 10 may, for example, be formed from low density polyethylene (LDPE), polyethylene terephthalate (PET), or recycled polyethylene terephthalate (rPET).

Figure 5:
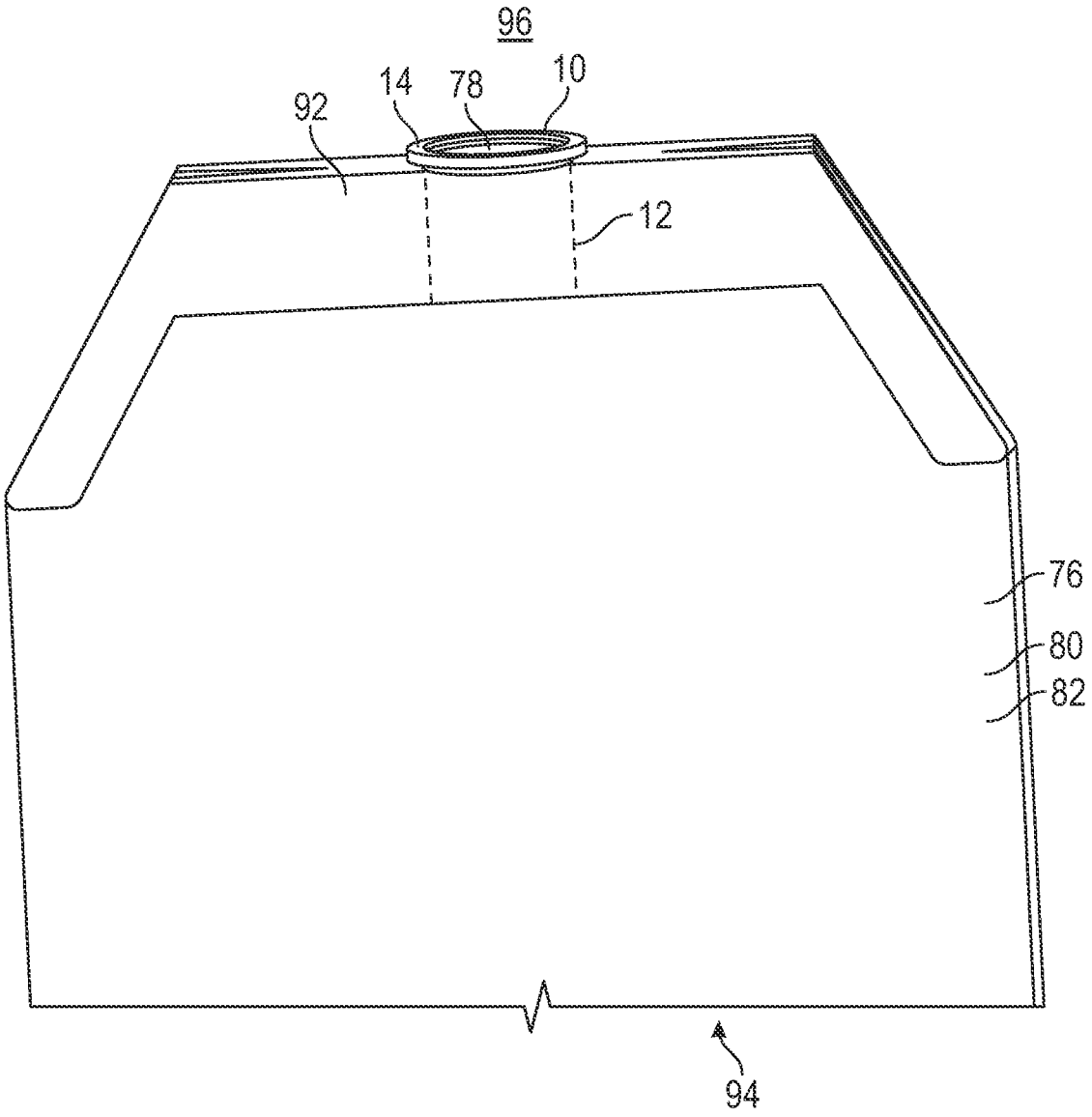
FIG. 5 is a perspective side view of the flexible pouch shown in FIG. 4, showing the mouth insert heat sealed in place to form the mouth of the flexible pouch.

The mouth insert 10 is designed to be heat sealed to a flexible pouch 76 to form the mouth 78 of the flexible pouch 76, as shown in FIG. 5. The mouth insert 10 is preferably formed from a material that can form a strong heat sealed connection to the flexible pouch 76. The flexible pouch 76 may, for example, have a body 82 that is made from a flexible film 80. The flexible film 80 may be made from a single material, or may have different layers made from different materials. If the flexible film 80 is made from a single material, the flexible film 80 is preferably made from the same material as the mouth insert 10. If the flexible film 80 has multiple layers, an inner layer of the film 80, which is heat sealed to the mouth insert 10, is preferably made from the same material as the mouth insert 10. The flexible film 80 is preferably made from a material that is easily recyclable, and that can be recycled together with the mouth insert 10 without requiring the mouth insert 10 to be separated from the flexible film 80. The flexible film 80, or the inner layer of the flexible film 80, preferably has the same melting temperature as the mouth insert 10. The film 80 may, for example, be formed by blown film extrusion. The film 80 is optionally made from or includes LDPE, PET, and/or rPET.

Figure 4:
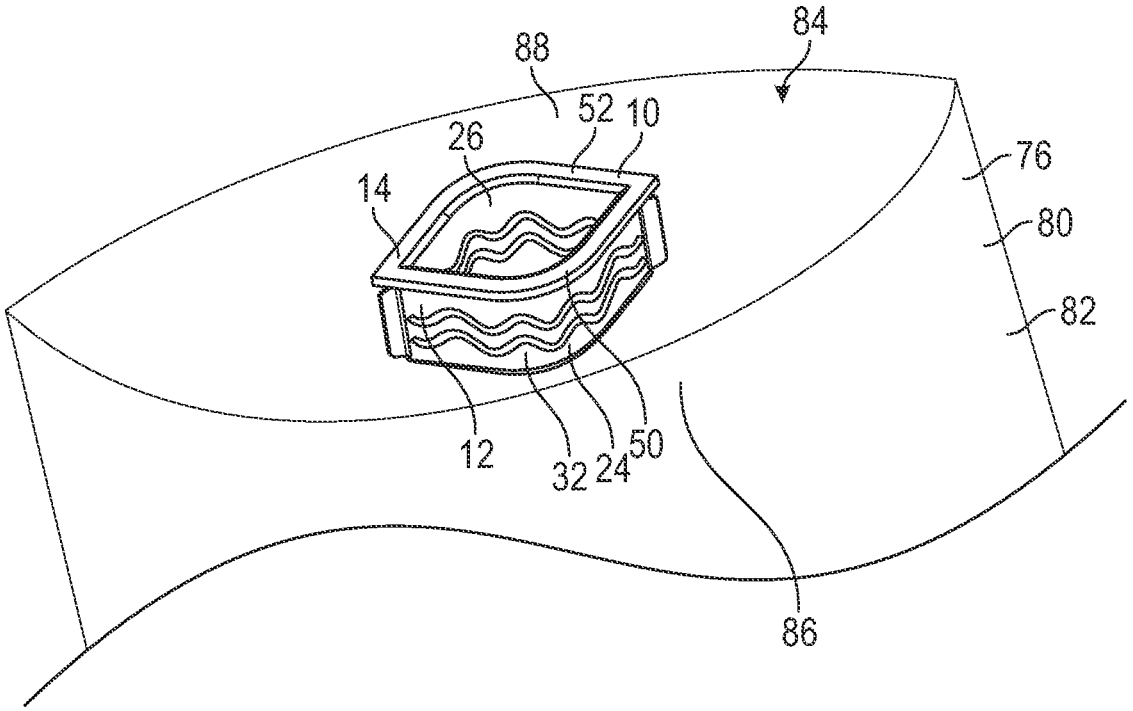
FIG. 4 is a top perspective view of the mouth insert shown in FIG. 1, showing the mouth insert placed in the open end of a flexible pouch, prior to heat sealing.

Referring to FIG. 4, during manufacturing of the flexible pouch 76 the mouth insert 10 is placed in an open end 84 of the body 82 of the flexible pouch 76, the body 82 of the flexible pouch 76 being formed from a flexible film 80. The mouth insert 10 is arranged with the outer surface 32 of the first sealing wall 24 facing towards a first portion 86 of the film 80, and with the outer surface 32 of the second sealing wall 26 facing towards a second portion 88 of the film 80. As is best shown in FIG. 8, the sealing portion 12 of the mouth insert 10 is positioned between the first portion 86 of the film 80 and the second portion 88 of the film 80, and the lip portion 14 extends axially outwardly past the axially outer ends of the first portion 86 of the film 80 and the second portion 88 of the film 80. The mouth insert 10 can be guided to the correct position by placing the mouth insert 10 so that the first shoulder 62 of the first lip 50 abuts the axially outer end of the first portion 86 of the film 80, and the second shoulder 64 of the second lip 52 abuts the axially outer end of the second portion 88 of the film 80.

Figure 9:
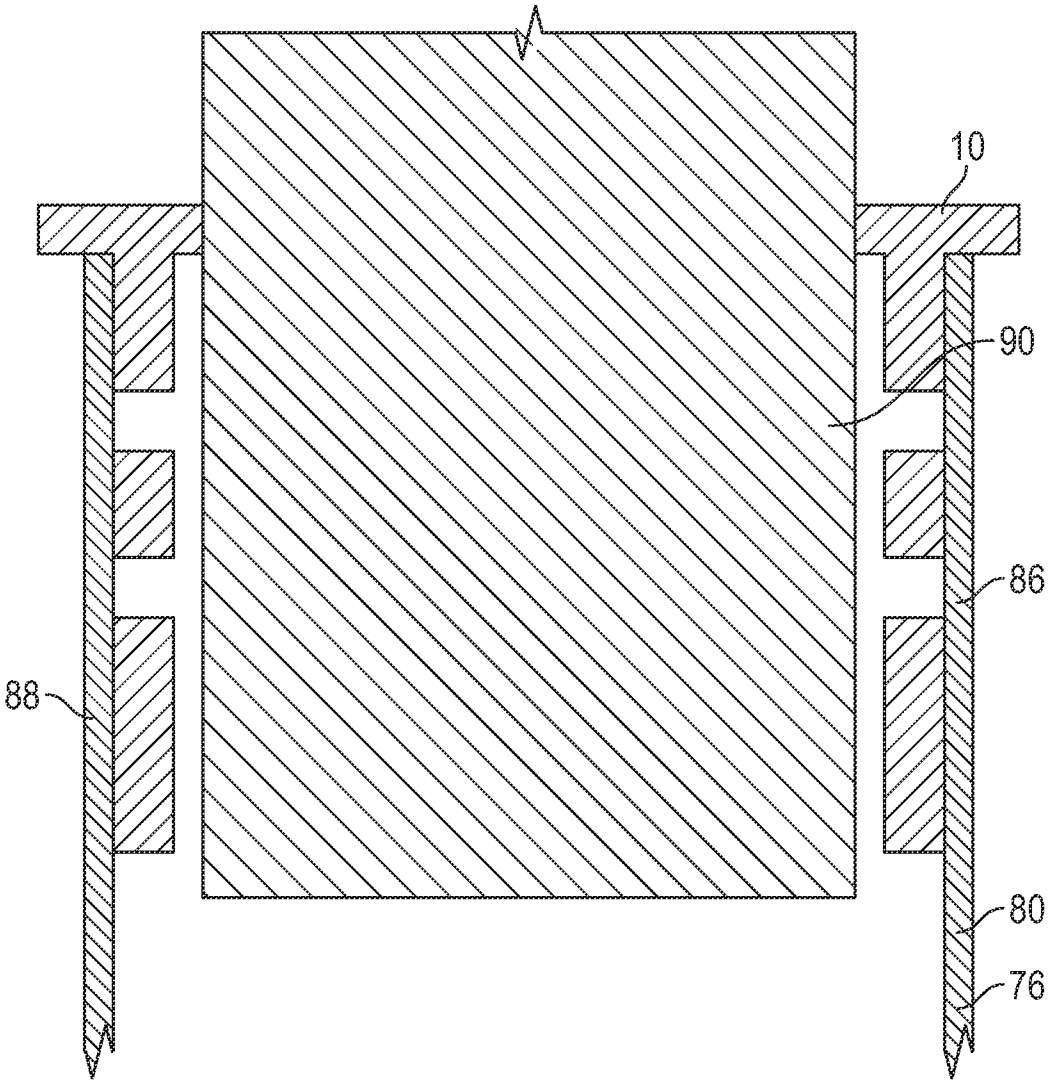
FIG. 9 is a schematic cross-sectional view of the flexible pouch shown in FIG. 8, further showing a core pin inserted into the mouth insert during heat sealing.

Once the mouth insert 10 is in the correct position in the open end 84 of the film 80, the mouth insert 10 is heat sealed in place by applying heat to the open end 84 of the film 80. Any suitable heat sealing device known in the art could be used. To prevent the convex walls 72, 74 of the mouth insert 10 from heat sealing to each other, a core pin 90 is preferably inserted into the passageway 16 before the heat is applied, as shown in FIG. 9. The core pin 90 is preferably made from a material that has a much higher melting temperature than the mouth insert 10, such as copper or brass. Once the heat sealing is finished, the core pin 90 is removed from the passageway 16.

After the heat sealing, the mouth insert 10 is embedded in a heat sealed portion 92 of the film 80 so as to form a mouth 78 of the flexible pouch 76. As can be seen in FIG. 5, only the lip portion 14 of the mouth insert 10 extends axially outwardly from the body 82 of the pouch 76. As shown by dotted lines in FIG. 5, the sealing portion 12 is embedded in the heat sealed portion 92 of the film 80. The passageway 16 of the mouth insert 10 extends from an internal compartment 94 of the flexible pouch 76, at the axially inner end 22 of the mouth insert 10, to an external environment 96, at the axially outer end 20 of the mouth insert 10.

Optionally, the film 80 can be folded or trimmed to any desired shape, such as by trimming the corners of the film 80 as shown in FIG. 5. The remainder of the pouch 76 may be formed in any suitable manner, such as by heat sealing the outer periphery of the film 80 so as to define the internal compartment 94. Preferably, the internal compartment 94 of the pouch 76 can only be accessed via the passageway 16 of the mouth insert 10.

The flexible pouch 76 with the mouth insert 10 embedded therein can optionally be packaged, shipped, and/or sold in an empty state. Advantageously, the flexibility of the mouth insert 10, as well as the relatively small weight and size of the mouth insert 10, preferably allows the flexible pouch 76 to be packaged and shipped in an efficient and cost effective manner.

The internal compartment 94 of the pouch 76 can then be filled with a flowable substance, such as a food product, a medicine, or a cleaning product. The flowable substance can be introduced to the internal compartment 94 via the passageway 16 of the mouth insert 10. Advantageously, the flexibility of the mouth insert 10 allows the passageway 16 to be held open to allow for efficient filling of the internal compartment 94.

Figure 12:
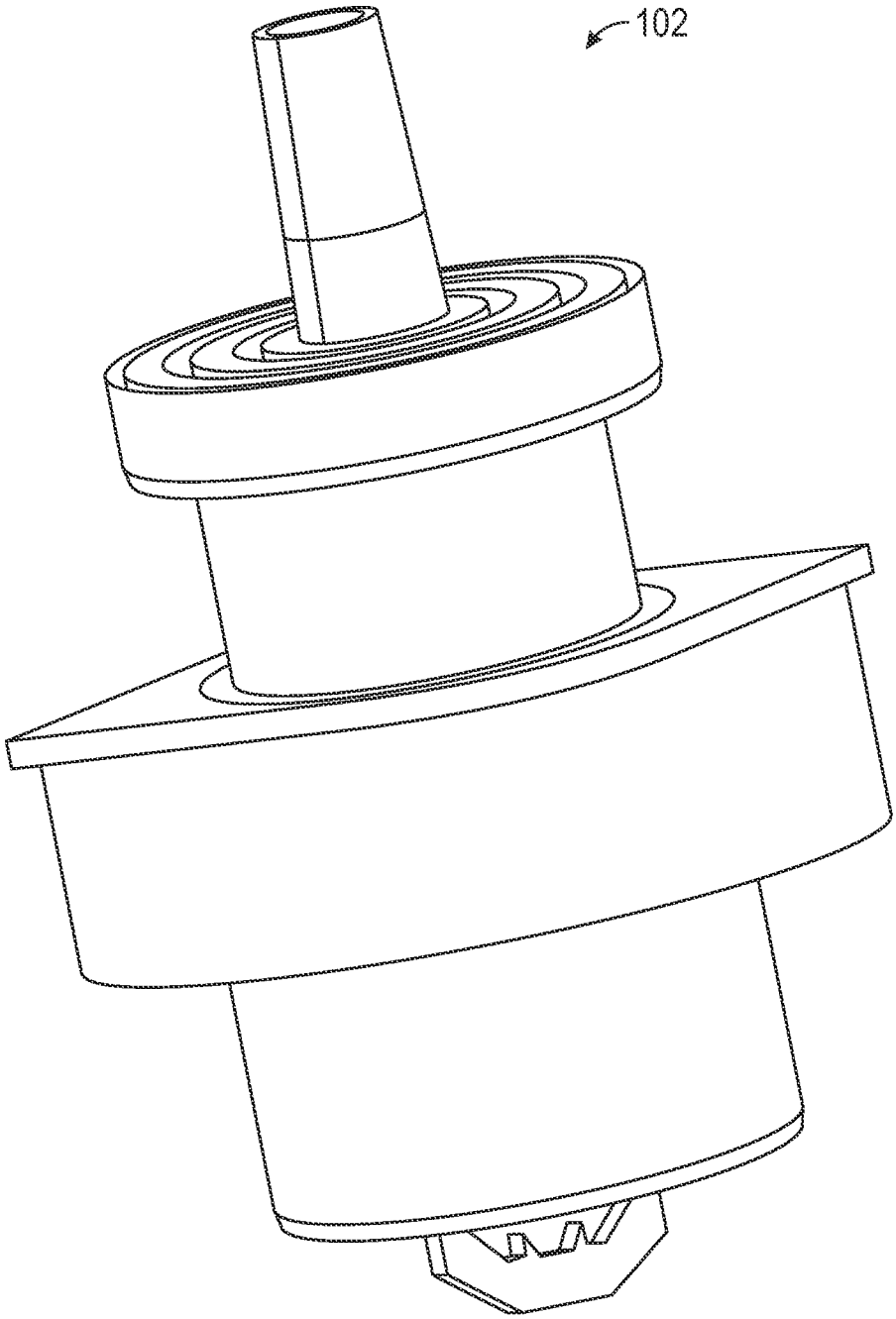
FIG. 12 is a perspective view of a fluid pump, configured to attach to the mouth insert shown in FIG. 1.

Once the compartment 94 is full, an attachment 98 can be connected to the mouth insert 10. Any desired attachment 98 may be selected to provide the desired functionality or functionalities, such as preventing the flowable substance from spilling out of the internal compartment 94 and/or allowing the pouch 76 to interface with another device, such as a dispenser, for dispensing the flowable substance from the pouch 76. The attachment 98 may, for example, be a spout 100 as shown in FIG. 6, a fluid pump 102 as shown in FIG. 12, or a closure such as a twist-top closure, not shown.

Figure 6:
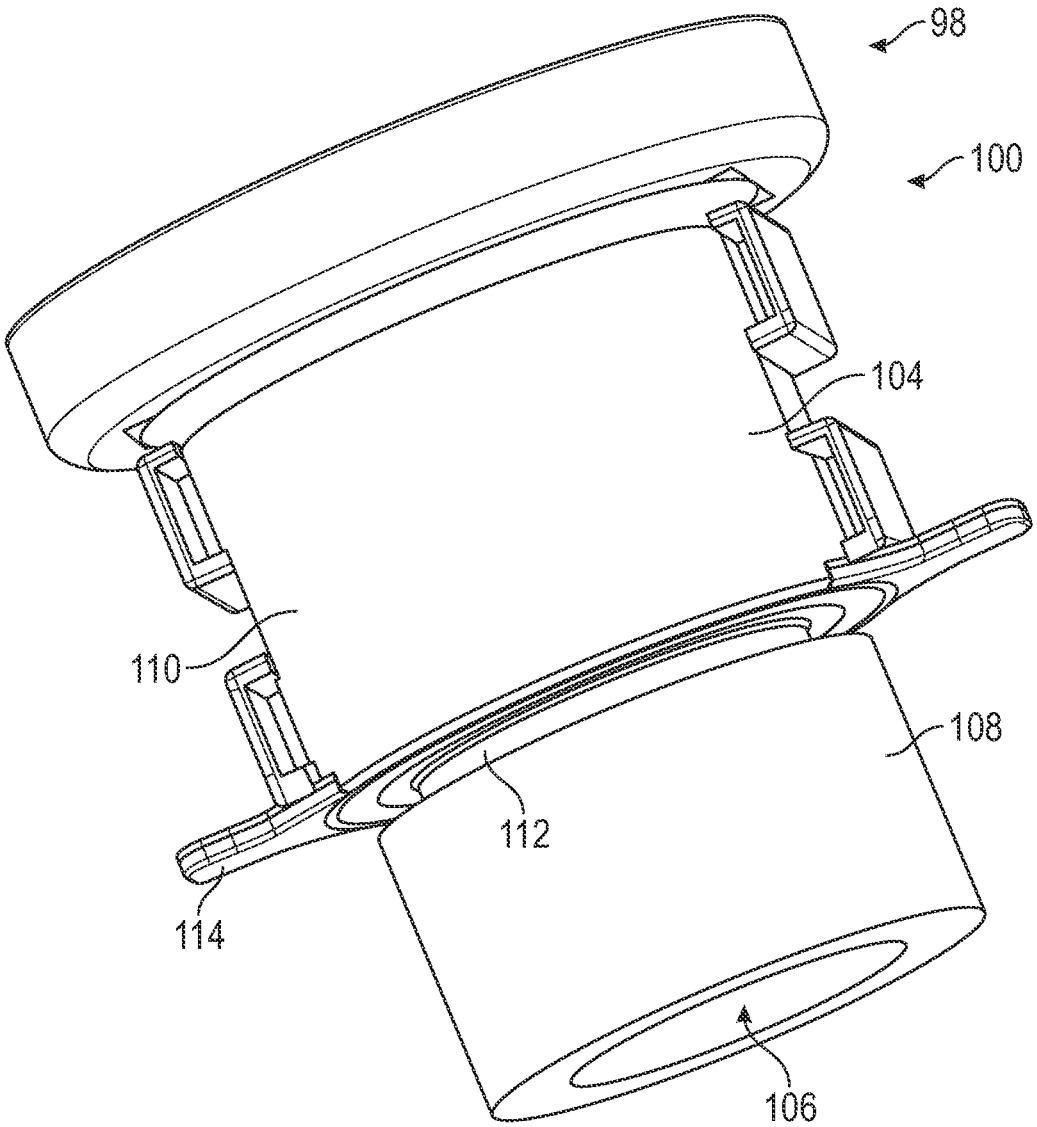
FIG. 6 is a perspective view of a spout, configured to attach to the mouth insert shown in FIG. 1.

Referring to FIG. 6, the attachment 98, which in this case is a spout 100, has a spout body 104 that defines an internal channel 106. The spout body 104 has an insertion portion 108 that is configured to be received in the passageway 16 of the mouth insert 10, and an extension portion 110 that is configured to extend axially outwardly from the mouth insert 10. The axially outer end of the insertion portion 108 has a groove 112 that is configured to receive the ridge 58 of the mouth insert 10 in a snap fit connection. The axially inner end of the extension portion 110 has a stop ring 114 that has a greater radial extent than the insertion portion 108. The stop ring 114 prevents the extension portion 110 from being inserted into the passageway 16 of the mouth insert 10.

Figure 7:
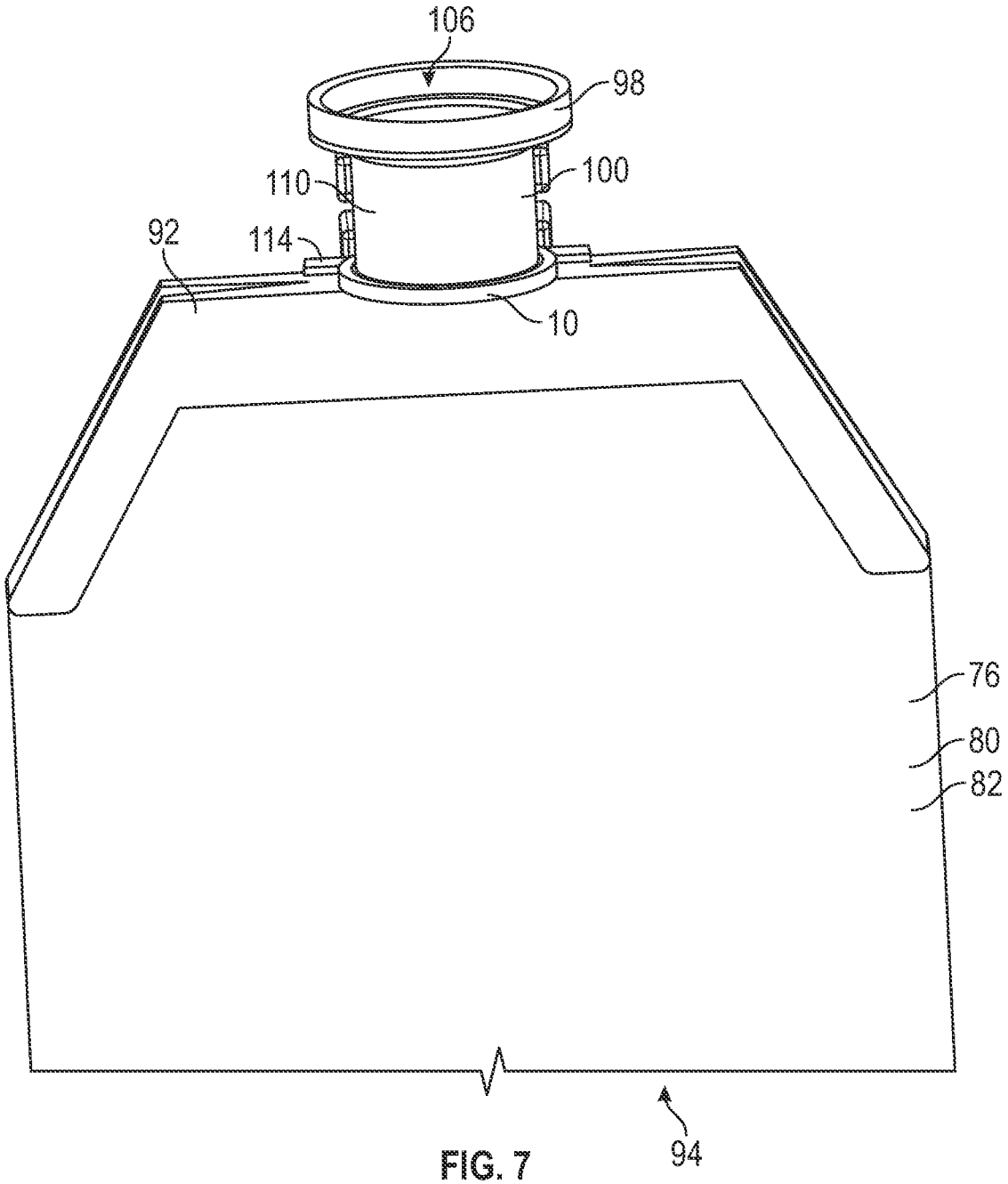
FIG. 7 is a perspective view of the flexible pouch shown in FIG. 5, with the spout shown in FIG. 6 connected to the mouth insert.
Figure 10:
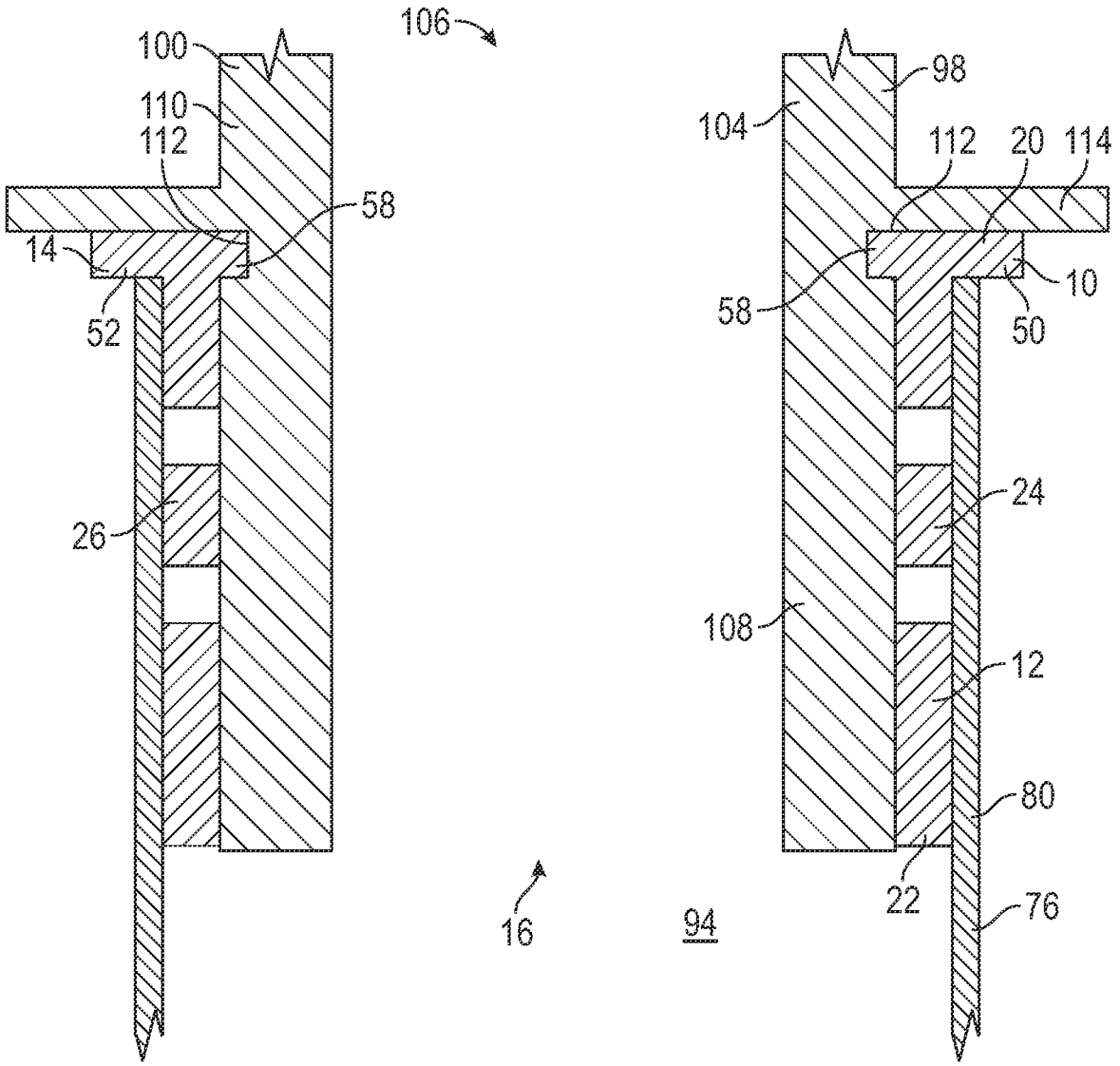
FIG. 10 is a schematic cross-sectional view of the flexible pouch with the spout connected to the mouth insert as shown in FIG. 7, showing the mouth insert in an unbiased condition.

When the spout 100 is connected to the mouth insert 10, as shown in FIG. 7, the insertion portion 108 sits inside the passageway 16, with the stop ring 114 positioned axially outwardly from the lip portion 14, and with the extension portion 110 extending axially outwardly from the mouth insert 10. As can be seen in FIG. 10, the ridge 58 is received in the groove 112 in a snap fit connection. The snap fit connection preferably provides a strong, fluid tight seal between the mouth insert 10 and the spout 100. Optionally, the connection between the mouth insert 10 and the spout 100 can be further strengthened by laser welding and/or ultrasonic welding.

The extension portion 110 may be configured to attach to other components or devices, such as a removable closure, not shown, that prevents the flowable substance from exiting the pouch 76 through the internal channel 106. The flexible pouch 76 can then, for example, be packaged, shipped, and sold to customers, who can remove the removable closure in order to dispense the flowable substance from the pouch 76.

Advantageously, because the spout 100 is a different component from the mouth insert 10, the spout 100 may be made from a different material than the mouth insert 10 without affecting the strength of the heat sealed connection between the mouth insert 10 and the film 80. The spout 100 may, for example, be made from a rigid material. Optionally, the spout 100 may be made from or include high density polyethylene (HDPE) or polypropylene (PP).

The fact that the mouth insert 10 is flexible and is only connected to the spout 100 at the axially outer end 20 of the mouth insert 10 preferably helps to improve the resiliency of the connection between the mouth insert 10 and the spout 100, and decrease the likelihood of the mouth insert 10 becoming disconnected from the spout 100. When the mouth insert 10 is in an unbiased condition, as shown in FIG. 10, the sealing walls 24, 26 of the mouth insert 10 extend parallel to the axis 18, adjacent to the insertion portion 108 of the spout 100. If the flexible pouch 76 is subjected to a compressive force, such as by dropping the flexible pouch 76 while the flexible pouch 76 is filled with a flowable substance, the compression of the pouch 76 will cause the fluid pressure within the internal compartment 94 to increase. Advantageously, the flexibility of the mouth insert 10 allows the axially inner end 22 of the mouth insert 10 to deflect radially outwardly, as shown in FIG. 11, when the fluid pressure within the internal compartment 94 increases. The slots 36, 38, 40, 42 help to increase the flexibility of the sealing walls 24, 26, so as to allow or enhance the ability of the axially inner end 22 of the mouth insert 10 to deflect radially outwardly.

The radially outward deflection of the axially inner end 22 of the mouth insert 10 provides space to accommodate the flowable substance displaced by the compressive force, and thereby acts to reduce the fluid pressure within the internal compartment 94. The relatively lower fluid pressure within the internal compartment 94 results in a relatively smaller force pulling the axially outer end 20 of the mouth insert 10 away from the spout 100, and thus preferably helps to decrease the likelihood of the mouth insert 10 becoming disconnected from the spout 100.

Figure 13:
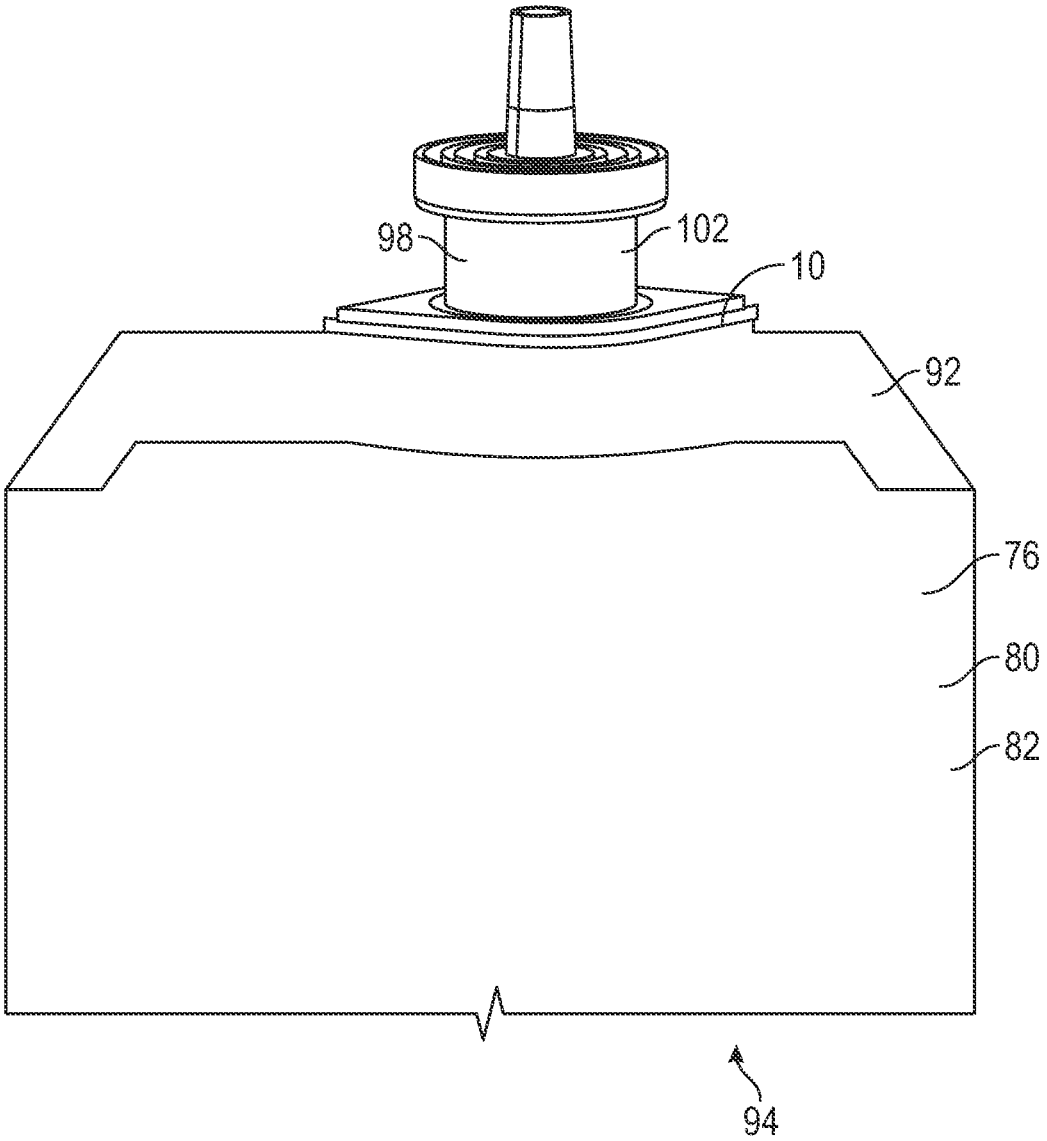
FIG. 13 is a perspective side view of a flexible pouch, with the mouth insert shown in FIG. 1 forming the mouth of the flexible pouch, and with the fluid pump shown in FIG. 12 connected to the mouth insert.

Other attachments 98, such as the fluid pump 102 shown in FIG. 13, could also be connected to the mouth insert 10. The fluid pump 102 shown in FIG. 13 may, for example, be used to connect the pouch 76 to a dispenser housing, not shown, and to dispense the flowable substance from the pouch 76 upon activation of the dispenser housing. Advantageously, the fluid pump 102 can preferably be connected directly to the mouth insert 10, rather than having to interface with a more bulky rigid spout such as that disclosed in United States Patent Application Publication No. US 2019/0358939 to Ophardt et al., published Nov. 28, 2019. This preferably helps to reduce material costs and environmental costs. The fluid pump 102 may, for example, be configured to connect to the mouth insert 10 with a snap fit connection in the same manner as the spout 100 described above.

Figure 14:
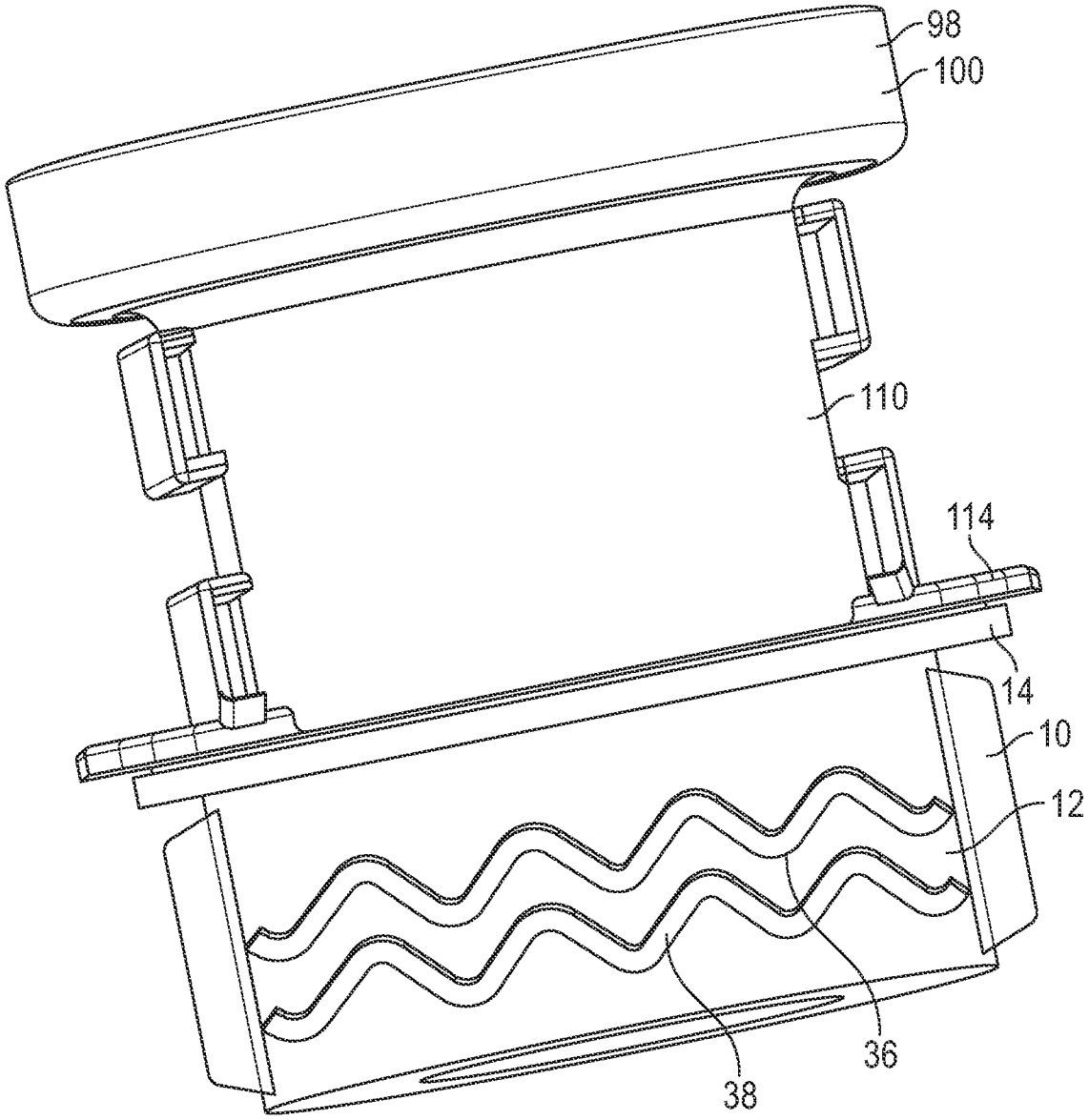
FIG. 14 is a perspective view of the mouth insert shown in FIG. 1 connected to the spout shown in FIG. 6.

Optionally, the spout 100 or other attachment 98 could be connected to the mouth insert 10 before the mouth insert 10 is connected to the pouch 76, as shown in FIG. 14. The spout 100 could be connected to the mouth insert 10 by way of the snap fit connection as described above. Optionally, laser welding and/or ultrasonic welding could be used in place of, or together with, the snap fit connection. Forming the mouth insert 10 and the spout 100 as separate components that are attached together allows the mouth insert 10 to be made from a flexible material that forms a strong heat sealed connection to the film 80 of the flexible pouch 76, while permitting the spout 100 to be made from a different material that may, for example, be rigid.

Figure 15:
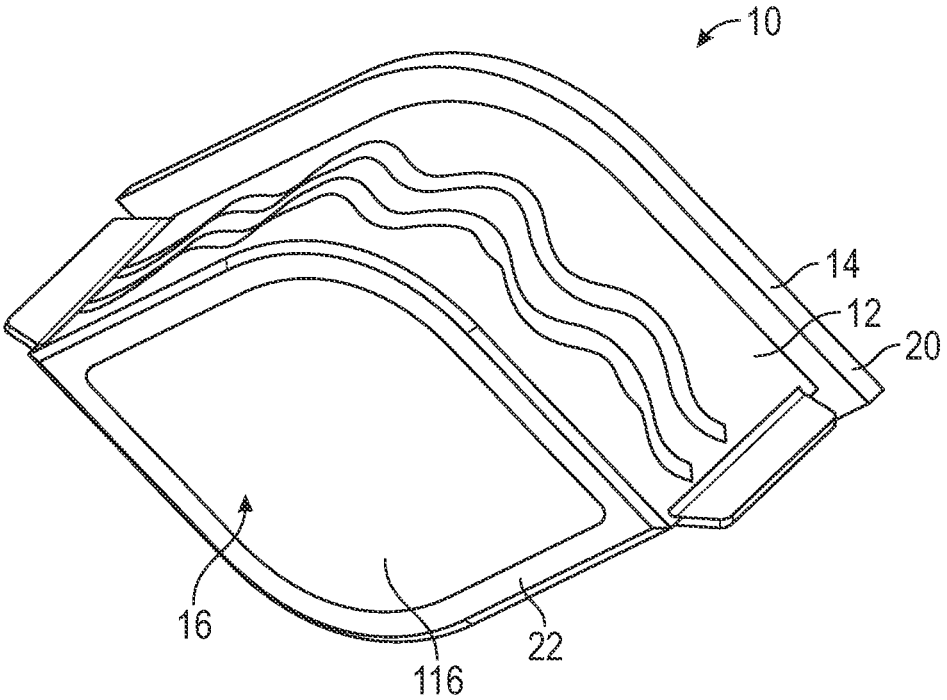
FIG. 15 is a bottom perspective view of a mouth insert in accordance with a second embodiment of the present invention.

Reference is now made to FIG. 15, which shows a mouth insert 10 in accordance with a second embodiment of the invention. Like numerals are used to denote like components. The mouth insert 10 shown in FIG. 15 is identical to the mouth insert 10 shown in FIGS. 1 to 3, with the only difference being that in the mouth insert 10 shown in FIG. 15 the passageway 16 is obstructed by a membrane 116 at the axially inner end 22 of the mouth insert 10.

The mouth insert 10 shown in FIG. 15 may be used to form the mouth 78 of a flexible pouch 76 and may be used in exactly the same ways as the mouth insert 10 shown in FIGS. 1 to 3, with the only difference being the manner in which the flexible pouch 76 is filled, and the manner in which the flowable substance may be dispensed from the pouch 76. In order to fill the flexible pouch 76, the membrane 116 needs to be pierced, for example by a needle. Preferably, the membrane 116 is formed from an elastic material that expands to substantially close the puncture hole after the needle is removed. The membrane 116 may, for example, be formed from LDPE, PET, rPET, and/or rubber.

The self-closing or self-healing membrane 116 is preferably able to prevent the flowable substance from leaking out of the flexible pouch 76, at least if no substantial compressive force is applied to the pouch 76. In some embodiments, the membrane 116 may be particularly effective at preventing relatively thick or viscous substances from leaking from the pouch 76. Optionally, the flowable substance may be dispensed from the pouch 76 merely by squeezing the pouch 76, forcing the flowable substance out through the puncture hole in the membrane 116. In this way, the pouch 76 may be used to store and dispense a flowable substance without requiring a separate attachment to be connected to the mouth insert 10.

Optionally, a pouch 76 having the mouth insert 10 shown in FIG. 15 may be attached directly to a pump of a dispenser housing. This may be advantageous, for example, for dispensers that have a permanent pump that is not replaced each time a new pouch 76 is installed in the dispenser. The mouth insert 10 may, for example, connect to the permanent pump using a snap fit connection as described above. When a pouch 76 having the mouth insert 10 shown in FIG. 15 is attached to a permanent pump, the pump preferably punctures or breaks the membrane 116, so as to allow the flowable substance to be dispensed from the pouch 76.

Figure 16:
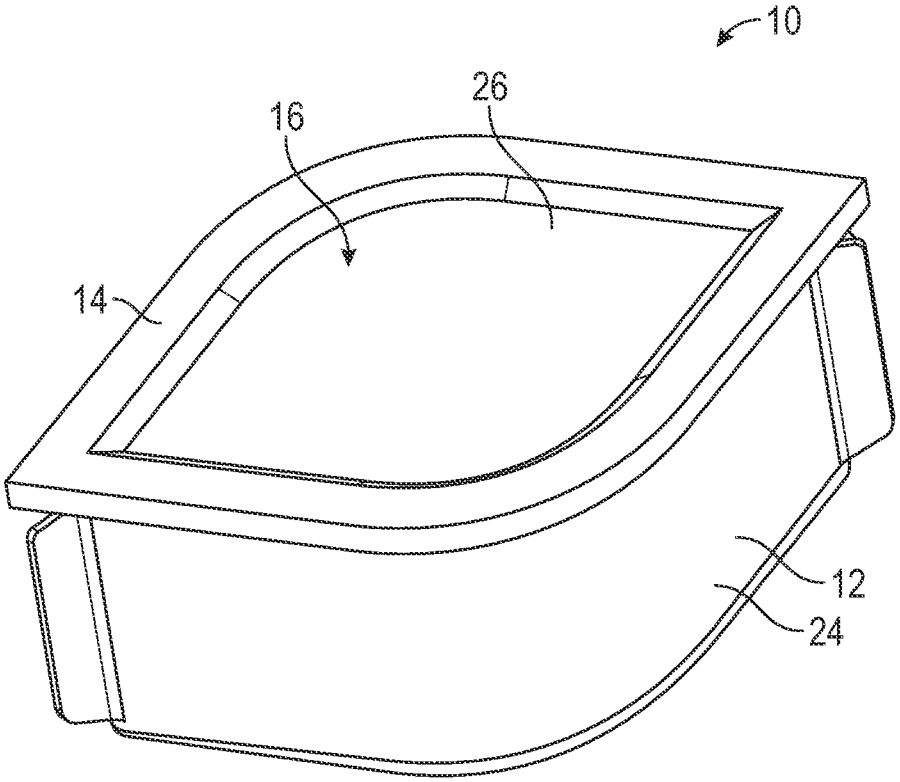
FIG. 16 is a top perspective view of a mouth insert in accordance with a third embodiment of the present invention.

Reference is now made to FIG. 16, which shows a mouth insert 10 in accordance with a third embodiment of the present invention. Like numerals are used to denote like components. The mouth insert 10 shown in FIG. 16 is identical to the mouth insert 10 shown in FIGS. 1 to 3, with the only difference being that the sealing walls 24, 26 do not have slots 36, 38, 40, 42.

The mouth insert 10 shown in FIG. 16 may be used in exactly the same ways as the mouth insert 10 shown in FIGS. 1 to 3. The slots 36, 38, 40, 42 may be omitted, for example, if the mouth insert 10 is made from a material that is sufficiently flexible such that the slots 36, 38, 40, 42 are not needed.

It will be understood that, although various features of the invention have been described with respect to one or another of the embodiments of the invention, the various features and embodiments of the invention may be combined or used in conjunction with other features and embodiments of the invention as described and illustrated herein.

The mouth insert 10 is not limited to the shape and size as shown in the drawings. Rather, any suitable shape and size could be used. For example, in some embodiments of the invention the lip portion 14 could be omitted, and the mouth insert 10 could be configured so as not to extend axially outwardly from the film 80. The sealing walls 24, 26 could, for example, have a ridge 58 that extends radially inwardly for forming a snap fit connection to an attachment 98, and the axially outer end 20 of the mouth insert 10 could be aligned with the axially outer end of the film 80. Preferably, the mouth insert 10 extends from 0 mm to 5 mm axially outwardly from the film 80. More preferably, the mouth insert 10 extends less than 4 mm, less than 3 mm, or less than 2 mm axially outwardly from the film 80.

In some embodiments of the invention, the ridge 58 could be omitted, and the mouth insert 10 could be connected to an attachment 98 by laser welding and/or by ultrasonic welding and/or by any other suitable method or technique.

The slots 36, 38, 40, 42 are not limited to the configuration shown in the preferred embodiments. Rather, any suitable size, shape, and number of slots 36, 38, 40, 42 could be used, or the slots 36, 38, 40, 42 could be omitted entirely, so as to provide the desired degree of flexibility and other desired properties of the mouth insert 10, such as heat sealing strength. The slots 36, 38, 40, 42 could, for example, be formed as straight lines, or could have different lengths, axial spacing, or number of waves.

The slots 36, 38, 40, 42 preferably have the wave-like shape as shown in FIGS. 1 to 3. The applicant has appreciated that the wave-like shape of the slots 36, 38, 40, 42 preferably helps to increase the resiliency of the connection between the mouth insert 10 and the film 80, and decrease the likelihood of the mouth insert 10 becoming separated from the film 80 when subjected to a pressure pulling the film 80 away from the mouth insert 10. In particular, the wave-like shape of the slots 36, 38, 40, 42 is believed to help distribute pressure along the length of the seal line between the film 80 and the mouth insert 10, so that the pressure is not concentrated at a single point along the seal line. Distributing the pressure along the length of the seal line preferably helps reduce the likelihood of the mouth insert 10 becoming separated from the film 80.

Optionally, in some embodiments of the invention the mouth insert 10 may be connected to the film 80 using both heat sealing and laser welding. For example, in a first step the mouth insert 10 may be heat sealed to the film 80 in the manner as described above. In a second step, laser welding may be used to further strengthen and enhance the seal between the mouth insert 10 and the film 80. The initial heat sealing step preferably holds the mouth insert 10 in place relative to the film 80, which preferably makes it easier to perform laser welding by preventing the mouth insert 10 from moving relative to the film 80 during the laser welding. Preferably, the laser welder is configured to weld along a set path. For example, the laser welder is preferably programmed to follow the wave-like contour around the outer periphery of the slots 36, 38, 40, 42, to produce a strong laser welded seal line around the slots 36, 38, 40, 42.

It is to be appreciated that the drawings are not necessarily drawn to scale, and the various components may have a different relative size compared to what is shown in the drawings. For example, in the cross-sectional views shown in FIGS. 8 to 11, the various components have been shown as having relatively similar thicknesses, in order to more clearly show the invention. However, in practice the various components may have significantly different thicknesses. For example, the film 80 may be significantly thinner than the mouth insert 10 and the attachment 98.

Although this disclosure has described and illustrated certain preferred embodiments of the invention, it is to be understood that the invention is not restricted to these particular embodiments. Rather, the invention includes all embodiments which are functional, chemical or mechanical equivalents of the specific embodiments and features that have been described and illustrated herein.

We claim:

1. A flexible pouch comprising:

a film that defines an internal compartment of the flexible pouch; and a mouth insert that is sealed between a first portion of the film and a second portion of the film to define a mouth of the flexible pouch;

the mouth insert defining a passageway that extends along an axis from an axially outer end of the mouth insert to an axially inner end of the mouth insert;

wherein the passageway extends from the internal compartment of the flexible pouch, at the axially inner end of the mouth insert, to an external environment, at the axially outer end of the mouth insert;

wherein the mouth insert is flexible;

wherein the mouth insert comprises:

a sealing portion that is sealed between the first portion of the film and the second portion of the film; and a lip portion configured to extend axially outwardly from the film;

wherein the lip portion defines the axially outer end of the mouth insert;

wherein the mouth insert has a mouth insert axial height, the sealing portion has a sealing portion axial height, and the lip portion has a lip portion axial height;

wherein the lip portion axial height is less than ⅓ of the mouth insert axial height;

wherein the sealing portion defines the axially inner end of the mouth insert; and wherein the mouth insert axial height is a sum of the sealing portion axial height and the lip portion axial height.

2. The flexible pouch according to claim 1, wherein, when the mouth insert is in an unbiased condition, the mouth insert has an eye-like shape when viewed from the axis, with two convex walls that are connected at two corners; and wherein the passageway is defined between the two convex walls.

3. The flexible pouch according to claim 1, wherein the mouth insert is at least one of:

injection molded;

extrusion molded;

formed from LDPE;

formed from PET; and formed from rPET.

4. The flexible pouch according to claim 1, wherein the mouth insert and the film are formed from the same material; or the film has an inner layer that is sealed to the mouth insert, and the mouth insert and the inner layer of the film are formed from the same material.

5. The flexible pouch according to claim 1, wherein the mouth insert extends less than 5 mm axially outwardly from the film.

6. The flexible pouch according to claim 5, wherein the sealing portion has a first sealing wall and a second sealing wall;

wherein the first sealing wall and the second sealing wall each have an outer surface and an inner surface;

wherein the outer surface of the first sealing wall is scaled to the first portion of the film;

wherein the outer surface of the second sealing wall is sealed to the second portion of the film; and wherein the passageway is defined, in part, between the inner surface of the first sealing wall and the inner surface of the second scaling wall.

7. The flexible pouch according to claim 6, wherein the lip portion has a first lip that extends axially outwardly from the first sealing wall of the sealing portion;

wherein the lip portion has a second lip that extends axially outwardly from the second sealing wall of the sealing portion;

wherein the first lip and the second lip each have an outside surface and an inside surface;

wherein the passageway is defined, in part, between the inside surface of the first lip and the inside surface of the second lip; and wherein the inside surface of the first lip extends radially inwardly, past the inner surface of the first sealing wall, and the inside surface of the second lip extends radially inwardly, past the inner surface of the second sealing wall.

8. The flexible pouch according to claim 7, further comprising an attachment that is attached to the mouth insert;

wherein the attachment extends into the passageway;

wherein the attachment is attached to the lip portion of the mouth insert; and wherein the attachment is unattached to the sealing portion of the mouth insert.

9. The flexible pouch according to claim 6, wherein the attachment comprises at least one of: a spout, a closure, and a pump; and wherein the attachment is connected to the mouth insert by at least one of: a snap fit connection, a laser weld, and an ultrasonic weld.

10. The flexible pouch according to claim 8, wherein the attachment has at least one groove that receives the inside surface of the first lip and the inside surface of the second lip in a snap fit.

11. The flexible pouch according to claim 8, wherein the mouth insert forms a liquid tight seal with the attachment:

wherein the attachment is formed from a different material than the mouth insert;

wherein the attachment is rigid; and wherein the attachment is formed from at least one of: HDPE and PP.

12. The flexible pouch according to claim 7, wherein the outside surface of the first lip extends radially outwardly, past the outer surface of the first sealing wall, and the outside surface of the second lip extends radially outwardly, past the outer surface of the second sealing wall;

wherein the first lip has a first axially inwardly facing shoulder that is positioned axially outwardly from an axially outer end of the first portion of the film; and wherein the second lip has a second axially inwardly facing shoulder that is positioned axially outwardly from an axially outer end of the second portion of the film.

13. The flexible pouch according to claim 6, wherein the first sealing wall has at least one slot that extends radially through the first sealing wall from the inner surface to the outer surface;

wherein the second sealing wall has at least one slot that extends radially through the second sealing wall from the inner surface to the outer surface; and wherein the at least one slot in the first sealing wall and the at least one slot in the second sealing wall each extend in a transverse direction that is perpendicular to the axis.

14. The flexible pouch according to claim 13, wherein the at least one slot in the first sealing wall and the at least one slot in the second sealing wall each have a wave-like shape.

15. The flexible pouch according to claim 5, wherein the passageway is obstructed by a membrane;

wherein the membrane is elastic; and wherein the lip portion axial height is less than ⅙ of the mouth insert axial height.

16. The flexible pouch according to claim 9, wherein the attachment has at least one groove that receives the inside surface of the first lip and the inside surface of the second lip in a snap fit;

wherein the mouth insert forms a liquid tight seal with the attachment;

wherein the attachment is formed from a different material than the mouth insert;

wherein the attachment is rigid; and wherein the attachment is formed from at least one of: HDPE and PP.

17. The flexible pouch according to claim 16, wherein the outside surface of the first lip extends radially outwardly, past the outer surface of the first sealing wall, and the outside surface of the second lip extends radially outwardly, past the outer surface of the second sealing wall;

wherein the first lip has a first axially inwardly facing shoulder that is positioned axially outwardly from an axially outer end of the first portion of the film;

wherein the second lip has a second axially inwardly facing shoulder that is positioned axially outwardly from an axially outer end of the second portion of the film;

wherein the first sealing wall has at least one slot that extends radially through the first sealing wall from the inner surface to the outer surface;

wherein the second sealing wall has at least one slot that extends radially through the second sealing wall from the inner surface to the outer surface;

wherein the at least one slot in the first sealing wall and the at least one slot in the second sealing wall each extend in a transverse direction that is perpendicular to the axis; and wherein the at least one slot in the first sealing wall and the at least one slot in the second sealing wall each have a wave-like shape.

18. The flexible pouch according to claim 17, wherein, when the mouth insert is in an unbiased condition, the mouth insert has an eye-like shape when viewed from the axis, with two convex walls that are connected at two corners;

wherein the passageway is defined between the two convex walls; and wherein the mouth insert is at least one of:

injection molded;

extrusion molded;

formed from LDPE;

formed from PET; and formed from rPET.

19. The flexible pouch according to claim 18, wherein the mouth insert and the film are formed from the same material; or the film has an inner layer that is sealed to the mouth insert, and the mouth insert and the inner layer of the film are formed from the same material.

20. The flexible pouch according to claim 14, wherein the passageway is obstructed by a membrane;

wherein the membrane is elastic; and wherein the lip portion axial height is less than ⅙ of the mouth insert axial height.

* * * * *